US009199695B2

(12) United States Patent
Gasper et al.

(10) Patent No.: US 9,199,695 B2
(45) **Date of Patent: *Dec. 1, 2015**

(54) SURF WAKE SYSTEM FOR A WATERCRAFT

(71) Applicant: MALIBU BOATS, LLC, Merced, CA (US)

(72) Inventors: Daniel Lee Gasper, Atwater, CA (US); Adam Andrew McCall, Greenback, TN (US); Wayne Richard Wilson, Knoxville, TN (US); Rachael Marie Green, Loudon, TN (US)

(73) Assignee: Malibu Boats, LLC, Merced, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/033,356

(22) Filed: Sep. 20, 2013

(65) Prior Publication Data

US 2014/0137786 A1 May 22, 2014

Related U.S. Application Data

(63) Continuation of application No. 13/830,799, filed on Mar. 14, 2013, now Pat. No. 8,539,897, which is a continuation of application No. 13/545,969, filed on Jul. 10, 2012, and a continuation-in-part of application (Continued)

(51) Int. Cl.
*B63B 1/22* (2006.01)
*B63B 1/32* (2006.01)
(Continued)

(52) U.S. Cl.
CPC ... *B63B 1/32* (2013.01); *B63B 1/28* (2013.01); *B63B 35/85* (2013.01)

(58) Field of Classification Search
CPC ..... B63B 1/28; B63B 1/32; B63B 35/85; B63B 39/06; B63B 2035/855
USPC ..... 114/271, 274–282, 284, 285
See application file for complete search history.

(56) References Cited

U.S. PATENT DOCUMENTS

| | | | |
|---|---|---|---|
| 3,294,052 | A | 12/1966 | Jones |
| 3,327,671 | A | 6/1967 | Comins |
| 4,434,738 | A | 3/1984 | Barkemeyer |

(Continued)

FOREIGN PATENT DOCUMENTS

| | | |
|---|---|---|
| EP | 1 435 325 | 7/2004 |
| EP | 1 058 645 | 10/2004 |

(Continued)

OTHER PUBLICATIONS

U.S. Appl. No. 13/545,969 including its prosecution history, filed Jul. 10, 2013, Gasper et al.

(Continued)

*Primary Examiner* — Daniel V Venne
(74) *Attorney, Agent, or Firm* — Knobbe, Martens, Olson & Bear, LLP

(57) ABSTRACT

An adjustable surf wake system enhances a wake formed by a watercraft travelling through water. The system may include a flap for deflecting water traveling past the stern of the watercraft, and/or a positioner operably connected to the flap for positioning the flap relative to a longitudinal axis of the watercraft between a neutral position and an outward position. Positioning a port flap in its extended position enhances a starboard surf wake, and positioning the starboard flap in its extended position enhances a port surf wake.

36 Claims, 21 Drawing Sheets

Related U.S. Application Data

No. PCT/US2012/055788, filed on Sep. 17, 2012.

(60) Provisional application No. 61/559,069, filed on Nov. 12, 2011, provisional application No. 61/535,438, filed on Sep. 16, 2011.

(51) Int. Cl.
*B63B 1/28* (2006.01)
*B63B 35/85* (2006.01)

(56) References Cited

U.S. PATENT DOCUMENTS

| | | | | |
|---|---|---|---|---|
| 5,058,520 | A | 10/1991 | Fahrney | |
| 5,113,780 | A | 5/1992 | Bennett et al. | |
| 5,193,478 | A | 3/1993 | Mardikian | |
| 5,263,432 | A | 11/1993 | Davis | |
| 5,359,956 | A | 11/1994 | Lee | |
| 5,385,110 | A | 1/1995 | Bennet et al. | |
| 5,549,071 | A | 8/1996 | Pigeon et al. | |
| 5,860,384 | A | 1/1999 | Castillo | |
| 5,860,766 | A | 1/1999 | Lochtefeld et al. | |
| 5,881,666 | A | 3/1999 | Crews, Jr. | |
| 5,911,190 | A | 6/1999 | Lochtefeld et al. | |
| 6,006,689 | A | 12/1999 | Olofsson | |
| 6,012,408 | A * | 1/2000 | Castillo | 114/280 |
| 6,026,759 | A | 2/2000 | Hazelett et al. | |
| 6,044,788 | A * | 4/2000 | Larson et al. | 114/253 |
| 6,105,527 | A | 8/2000 | Lochtefeld et al. | |
| 6,138,601 | A | 10/2000 | Anderson et al. | |
| 6,148,756 | A | 11/2000 | Pavlov et al. | |
| 6,213,044 | B1 | 4/2001 | Rodgers et al. | |
| 6,520,104 | B1 | 2/2003 | Svensson | |
| 6,874,441 | B2 | 4/2005 | Pigeon | |
| 6,923,136 | B1 | 8/2005 | D'Alessandro | |
| 6,935,263 | B1 | 8/2005 | Bandyopadhyay | |
| 6,941,884 | B2 | 9/2005 | Moore | |
| 7,063,031 | B2 | 6/2006 | Earl, Jr. et al. | |
| 7,140,318 | B1 | 11/2006 | Gasper | |
| 7,210,422 | B1 | 5/2007 | Hickok et al. | |
| 7,246,565 | B2 | 7/2007 | Snook et al. | |
| 7,252,047 | B1 | 8/2007 | Baucom, Jr. | |
| 7,311,058 | B1 | 12/2007 | Brooks et al. | |
| 7,434,531 | B1 | 10/2008 | Zsido et al. | |
| 7,467,596 | B2 | 12/2008 | Salmon | |
| 7,641,525 | B2 | 1/2010 | Morvillo | |
| 7,707,956 | B2 | 5/2010 | Moore | |
| 7,780,490 | B2 | 8/2010 | Lundgren | |
| 8,191,493 | B2 | 6/2012 | Baywol | |
| 8,387,551 | B2 | 3/2013 | Muller | |
| 8,534,214 | B1 | 9/2013 | Gasper | |
| 8,539,897 | B1 | 9/2013 | Gasper et al. | |
| 8,578,873 | B2 | 11/2013 | Gasper et al. | |
| 8,833,286 | B1 | 9/2014 | Sheedy et al. | |
| 2004/0261684 | A1 | 12/2004 | Pigeon | |
| 2005/0124234 | A1 | 6/2005 | Sells et al. | |
| 2005/0155540 | A1 | 7/2005 | Moore | |
| 2006/0054067 | A1 | 3/2006 | Hoberman et al. | |
| 2007/0078575 | A1 | 4/2007 | Wilson et al. | |
| 2007/0125287 | A1 | 6/2007 | Walker | |
| 2008/0271660 | A1 | 11/2008 | Zsido et al. | |
| 2010/0121493 | A1 * | 5/2010 | Christensen et al. | 700/275 |
| 2010/0251952 | A1 | 10/2010 | Baywol | |
| 2011/0017115 | A1 | 1/2011 | Olofsson | |
| 2014/0026799 | A1 | 1/2014 | Kalil | |

FOREIGN PATENT DOCUMENTS

| | | |
|---|---|---|
| WO | WO 2007/072185 | 6/2007 |
| WO | WO 2009/113923 | 9/2009 |

OTHER PUBLICATIONS

U.S. Appl. No. 13/749,500 including its prosecution history, filed Jan. 24, 2013, Gasper et al.

U.S. Appl. No. 14/026,983 including its prosecution history, filed Sep. 13, 2013, Gasper.

U.S. Appl. No. 14/075,978 including its prosecution history, filed Nov. 8, 2013, Gasper et al.

U.S. Appl. No. 14/082,086 including its prosecution history, filed Nov. 15, 2013.

MasterCraft Surf Tab—Screenshots taken from video uploaded on May 26, 2010 at http://www.youtube.com/watch?v=b1Q_MLRO31M.

Tige Convex VX—Screenshots taken from video uploaded on Oct. 10, 2012 at http://www.youtube.com/watch?v=jx5QXC-dU9w.

Centurion Wake Plate—Website dated Aug. 27, 2011—http://www.centurionboats.com/features-and-options/adjustable-wake-plate.html.

Nautique Surf System—Released Jan. 3, 2013—Website printout from http://www.nautique.com/models/nautique-surf-system.

International Search Report dated Dec. 6, 2012 for PCT/US2012/055788.

International Search Report dated Jan. 25, 2013 for PCT/US2012/064504.

Malibu's First Amended Complaint: Infringement of U.S. Pat. Nos. 8,539,897; 8,534,214; and 8,573,873, filed on Dec. 13, 2013 in *Malibu Boats, LLC* v. *Nautique Boat Co.*, Case No. 3:13-cv-00656, in the United States District Court for the Eastern District of Tennessee.

Malibu's Opening Brief on Its Motion for a Preliminary Injunction, filed on Nov. 14, 2013, in *Malibu Boats, LLC* v. *Nautique Boat Co.*, Case No. 3:13-cv-00656, in the United States District Court for the Eastern District of Tennessee.

Nautique's Opposition to Malibu's Motion for a Preliminary Injunction, filed on Dec. 16, 2013 in *Malibu Boats, LLC* v. *Nautique Boat Co.*, Case No. 3:13-cv-00656, in the United States District Court for the Eastern District of Tennessee.

Malibu's Reply Brief on its Motion for Preliminary Injunction, filed Dec. 23, 2013 in *Malibu Boats, LLC* v. *Nautique Boat Co.*, Case No. 3:13-cv-00656, in the United States District Court for the Eastern District of Tennessee.

Volvo Penta—QL Boat Trim System Brochure—The Declaration of David Kennedy states that this brochure became publicly available prior to 2010.

Volvo Penta—QL Boat Trim System User & Installation Instructions—The Declaration of David Kennedy states that these instructions became publicly available prior to 2010.

Declaration of David Kennedy, dated Dec. 13, 2013, in *Malibu Boats, LLC* v. *Nautique Boat Co.*, Case No. 3:13-cv-00656, in the United States District Court for the Eastern District of Tennessee.

Declaration of Kevin C. Breen in Support of Malibu's Motion for Preliminary Injunction, dated Nov. 12, 2013, in *Malibu Boats, LLC* v. *Nautique Boat Co.*, Case No. 3:13-cv-00656, in the United States District Court for the Eastern District of Tennessee.

Declaration of Elliot L Stern, Ph.D., P.E. Regarding Non-Infringement and Invalidity of U.S. Pat. No. 8,539,897, dated Dec. 16, 2013, in *Malibu Boats, LLC* v. *Nautique Boat Co.*, Case No. 3:13-cv-00656, in the United States District Court for the Eastern District of Tennessee.

Supplemental Declaration of Kevin C. Breen in Support of Malibu's Motion for Preliminary Injunction, dated Dec. 23, 2013, in *Malibu Boats, LLC* v. *Nautique Boat Co.*, Case No. 3:13-cv-00656, in the United States District Court for the Eastern District of Tennessee.

Declaration of Richard D. Hepburn, Regarding Claim Construction, Non-Infringement, and Invalidity, dated Dec. 16, 2013, in *Malibu Boats, LLC* v. *Nautique Boat Co.*, Case No. 3:13-cv-00656, in the United States District Court for the Eastern District of Tennessee.

Declaration of Greg Meloon in Support of Opposition to Motion for Preliminary Injunction, dated Dec. 14, 2013, in in *Malibu Boats, LLC* v. *Nautique Boat Co.*, Case No. 3:13-cv-00656, in the United States District Court for the Eastern District of Tennessee.

Memorandum Opinion and Order Denying Malibu's Motion for Preliminary Injunction, filed Feb. 4, 0214 in *Malibu Boats, LLC* v. *Nautique Boat Co.*, Case No. 3:13-cv-00656, in the United States District Court for the Eastern District of Tennessee.

U.S. Appl. No. 14/666,204 including its prosecution history, filed Mar. 23, 2015, Gasper et al.

Humphree Operator's Manual, dated 2009.

(56) References Cited

OTHER PUBLICATIONS

Humphree Installation Manual, dated 2009.
"Malibu Makes Boating Easier and More Fun With MaliView," dated Sep. 4, 2008.
Defendant's Responses to Plaintiff's First Set of Interrogatories, dated Feb. 26, 2014 in *Malibu Boats, LLC* v. *Nautique Boat Co.*, Case No. 3:13-cv-00656, in the United States District Court for the Eastern District of Tennessee.
Defendant's First Supplemental Responses to Plaintiff's First Set of Interrogatories (Nos. 1-2), dated Apr. 18, 2014, in *Malibu Boats, LLC* v. *Nautique Boat Co.*, Case No. 3:13-cv-00656, in the United States District Court for the Eastern District of Tennessee.
Malibu's Opening Brief in Support of its Motion for Summary Judgment of Infringement [Redacted Public Version], filed Jun. 26, 2014 in *Malibu Boats, LLC* v. *Nautique Boat Co.*, Case No. 3:13-cv-00656, in the United States District Court for the Eastern District of Tennessee.
Exhibit 7 to Declaration of Mark Lezama in Support of Malibu's Motion for Summary Judgment of Infringement [Redacted Public Version], filed Jun. 17, 2014 in *Malibu Boats, LLC* v. *Nautique Boat Co.*, Case No. 3:13-cv-00656, in the United States District Court for the Eastern District of Tennessee.
Malibu's Statement of Undisputed Facts in Support of Its Motion for Summary Judgment of Infringement, filed Jun. 17, 2014 in *Malibu Boats, LLC* v. *Nautique Boat Co.*, Case No. 3:13-cv-00656, in the United States District Court for the Eastern District of Tennessee.
Declaration of Kevin C. Breen in Support of Malibu's Motion for Summary Judgment of Infringement [Redacted Public Version], filed Jun. 26, 2014 in *Malibu Boats, LLC* v. *Nautique Boat Co.*, Case No. 3:13-cv-00656, in the United States District Court for the Eastern District of Tennessee.
Nautique's Motion for Claim Term Interpretation of U.S. Pat. No. 8,539,897, filed Aug. 26, 2014 in *Malibu Boats, LLC* v. *Nautique Boat Co.*, Case No. 3:13-cv-00656, in the United States District Court for the Eastern District of Tennessee.
Nautique's Motion for Claim Term Interpretation of U.S. Pat. No. 8,5378,873, filed Aug. 26, 2014 in *Malibu Boats, LLC* v. *Nautique Boat Co.*, Case No. 3:13-cv-00656, in the United States District Court for the Eastern District of Tennessee.
Nautique's Motion for Claim Term Interpretation of U.S. Pat. No. 8,534,214, filed Aug. 26, 2014 in *Malibu Boats, LLC* v. *Nautique Boat Co.*, Case No. 3:13-cv-00656, in the United States District Court for the Eastern District of Tennessee.
Nautique's Opposition to Malibu's Motion for Partial Summary Judgement, filed Aug. 29, 2014 in *Malibu Boats, LLC* v. *Nautique Boat Co.*, Case No. 3:13-cv-00656, in the United States District Court for the Eastern District of Tennessee.
Malibu's Response to Nautique's Second set of Interrogatories (No. 9), dated Apr. 21, 2014 in *Malibu Boats, LLC* v. *Nautique Boat Co.*, Case No. 3:13-cv-00656, in the United States District Court for the Eastern District of Tennesse.
Malibu's Supplemental Response to Nautique's Interrogatories 2, 3, 7, and 8 with Exhibit 1, dated Sep. 4, 2014 in *Malibu Boats, LLC* v. *Nautique Boat Co.*, Case No. 3:13-cv-00656, in the United States District Court for the Eastern District of Tennesse.
Malibu's Supplemental Response to Nautique's Interrogatories 1 and 6, dated Nov. 13, 2014 in *Malibu Boats, LLC* v. *Nautique Boat Co.*, Case No. 3:13-cv-00656, in the United States District Court for the Eastern District of Tennesse.
Malibu's Opening Brief on its Motion for Summary Judgment of No Invalidity Based on Svensson and Accompanying Declarations From Mark Lezama and Kevin Breen, filed Sep. 12, 2014 in *Malibu Boats, LLC* v. *Nautique Boat Co.*, Case No. 3:13-cv-00656, in the United States District Court for the Eastern District of Tennessee.
Nautique's Corrected Motion for Summary Judgment of Invalidity, filed Sep. 12, 2014 in *Malibu Boats, LLC* v. *Nautique Boat Co.*, Case No. 3:13-cv-00656, in the United States District Court for the Eastern District of Tennessee.
Nautique's Motion for Summary Judgment of Non-Infringement, filed Sep. 12, 2014 in *Malibu Boats, LLC* v. *Nautique Boat Co.*, Case No. 3:13-cv-00656, in the United States District Court for the Eastern District of Tennessee.
Malibu's Reply Brief on its Motion for Summary Judgement of Infringement [Redacted Version], filed Sep. 15, 2014 in *Malibu Boats, LLC* v. *Nautique Boat Co.*, Case No. 3:13-cv-00656, in the United States District Court for the Eastern District of Tennessee.
Malibu's Opposition to Nautique's Motion for Claim Interpretation of U.S. Pat. No. 8,539,897, filed Sep. 19, 2014 in *Malibu Boats, LLC* v. *Nautique Boat Co.*, Case No. 3:13-cv-00656, in the United States District Court for the Eastern District of Tennessee.
Malibu's Opposition to Nautique's Motion for Claim Interpretation of U.S. Pat. No. 8,534,214, filed Sep. 19, 2014 in *Malibu Boats, LLC* v. *Nautique Boat Co.*, Case No. 3:13-cv-00656, in the United States District Court for the Eastern District of Tennessee.
Malibu's Opposition to Nautique's Motion for Claim Interpretation of U.S. Pat. No. 8,578,873, filed Sep. 19, 2014 in *Malibu Boats, LLC* v. *Nautique Boat Co.*, Case No. 3:13-cv-00656, in the United States District Court for the Eastern District of Tennessee.
Nautique's Reply to Opposition to Motion for Claim Interpretation of U.S. Pat. No. 8,539,897, filed Sep. 29, 2014 in *Malibu Boats, LLC* v. *Nautique Boat Co.*, Case No. 3:13-cv-00656, in the United States District Court for the Eastern District of Tennessee.
Nautique's Reply to Opposition to Motion for Claim term Interpretation of U.S. Pat. No. 8,534,214, filed Sep. 29, 2014 in *Malibu Boats, LLC* v. *Nautique Boat Co.*, Case No. 3:13-cv-00656, in the United States District Court for the Eastern District of Tennessee.
Nautique's Reply to Opposition to Motion for Claim Interpretation of U.S. Pat. No. 8,578,873, filed Sep. 29, 2014 in *Malibu Boats, LLC* v. *Nautique Boat Co.*, Case No. 3:13-cv-00656, in the United States District Court for the Eastern District of Tennessee.
Nautique's Opposition to Malibu's Motion for Summary Judgment of No Invalidity Based on Svensson, filed Oct. 6, 2014 in *Malibu Boats, LLC* v. *Nautique Boat Co.*, Case No. 3:13-cv-00656, in the United States District Court for the Eastern District of Tennesse.
Malibu's Opposition to Nautique's Corrected Motion for Summary Judgment of Invalidity [Redacted Public Version], Filed Oct. 8, 2014 in *Malibu Boats, LLC* v. *Nautique Boat Co.*, Case No. 3:13-cv-00656, in the United States District Court for the Eastern District of Tennesse.
Malibu's Opposition to Nautique's Motion for Summary Judgment of Non-Infringement [Redacted Public Version], filed Oct. 8, 2014 in *Malibu Boats, LLC* v. *Nautique Boat Co.*, Case No. 3:13-cv-00656, in the United States District Court for the Eastern District of Tennesse.
Declaration of Kevin Breen in Support of Malibu's Opposition to Nautique's Corrected Motion for Summary Judgment of Invalidity, filed Oct. 6, 2014 in *Malibu Boats, LLC* v. *Nautique Boat Co.*, Case No. 3:13-cv-00656, in the United States District Court for the Eastern District of Tennesse.
Declaration of Kevin Breen in Support of Malibu's Opposition to Nautique's Motion for Summary Judgment of Non-Infringement, filed Oct. 6, 2014 in *Malibu Boats, LLC* v. *Nautique Boat Co.*, Case No. 3:13-cv-00656, in the United States District Court for the Eastern District of Tennesse.
Nautique's Reply in Support of its Motion for Summary Judgment of Invalidity [Redacted Public Version], filed Oct. 17, 2014 in *Malibu Boats, LLC* v. *Nautique Boat Co.*, Case No. 3:13-cv-00656, in the United States District Court for the Eastern District of Tennesse.
Malibu's Reply Brief on its Motion for Summary Judgment of No Invalidity Based on Svensson, filed Oct. 17, 2014 in *Malibu Boats, LLC* v. *Nautique Boat Co.*, Case No. 3:13-cv-00656, in the United States District Court for the Eastern District of Tennesse.
Nautique's Reply to Opposition to Motion for Summary Judgment of Non-Infringment [Redacted Version], filed Oct. 17, 2014 in *Malibu Boats, LLC* v. *Nautique Boat Co.*, Case No. 3:13-cv-00656, in the United States District Court for the Eastern District of Tennesse.
Nautique's Supplemental Brief in Support of Pending Motions [Redacted Version], filed Dec. 9, 2014 in *Malibu Boats, LLC* v. *Nautique Boat Co.*, Case No. 3:13-cv-00656, in the United States District Court for the Eastern District of Tennesse.

(56) References Cited

OTHER PUBLICATIONS

Malibu's Response to Nautique's Supplemental Brief, filed Dec. 22, 2014 in *Malibu Boats, LLC* v. *Nautique Boat Co.*, Case No. 3:13-cv-00656, in the United States District Court for the Eastern District of Tennesse.
Transcript of Preliminary Injunction Hearing on Jan. 6, 2014.
Transcript of Motion Hearing on Dec. 16, 2014.
Malibu's slides presented during hearing on Dec. 16, 2014.
Nautique's slides presented during hearing on Dec. 16, 2014.
Malibu's Daubert Motion to Exclude Opinions on Inherency, filed Dec. 26, 2014 in *Malibu Boats, LLC* v. *Nautique Boat Co.*, Case No. 3:13-cv-00656, in *Malibu Boats, LLC* v. *Nautique Boat Co.*, Case No. 3:13-cv-00656, in the United States District Court for the Eastern District of Tennessee.
Defendant's Opposition to Plaintiff's Daubert Motion to Exclude Opinions on Inherency, filed Jan. 12, 2015 in *Malibu Boats, LLC* v. *Nautique Boat Co.*, Case No. 3:13-cv-00656, in *Malibu Boats, LLC* v. *Nautique Boat Co.*, Case No. 3:13-cv-00656, in the United States District Court for the Eastern District of Tennessee.
Malibu's Reply Brief on its Daubert Motion to Exclude Opinions on Inherency, filed Jan. 19, 2015 in *Malibu Boats, LLC* v. *Nautique Boat Co.*, Case No. 3:13-cv-00656, in the United States District Court for the Eastern District of Tennessee.
Memorandum and Order for Daubert Motion, dated Jan. 26, 2015 in *Malibu Boats, LLC* v. *Nautique Boat Co.*, Case No. 3:13-cv-00656, in the United States District Court for the Eastern District of Tennessee.
Expert Report of Robert Taylor (pp. 1-444), dated Nov. 21, 2014 in *Malibu Boats, LLC* v. *Nautique Boat Co.*, Case No. 3:13-cv-00656, in the United States District Court for the Eastern District of Tennessee.
Expert Report of Robert Taylor (pp. 445-914), dated Nov. 21, 2014 in *Malibu Boats, LLC* v. *Nautique Boat Co.*, Case No. 3:13-cv-00656, in the United States District Court for the Eastern District of Tennessee.
Expert Supplemental Report of Robert Taylor, dated Dec. 5, 2014 in *Malibu Boats, LLC* v. *Nautique Boat Co.*, Case No. 3:13-cv-00656, in the United States District Court for the Eastern District of Tennessee.
Transcript of Deposition of Robert Taylor, dated Jan. 7, 2015 in *Malibu Boats, LLC* v. *Nautique Boat Co.*, Case No. 3:13-cv-00656, in the United States District Court for the Eastern District of Tennessee.
Memorandum and Order, dated Jan. 28, 2015 in *Malibu Boats, LLC* v. *Nautique Boat Co.*, Case No. 3:13-cv-00656, in *Malibu Boats, LLC* v. *Nautique Boat Co.*, Case No. 3:13-cv-00656, in the United States District Court for the Eastern District of Tennessee.
Petition for Inter Partes Review of U.S. Pat. No. 8,539,897, filed Jun. 27, 2014.
Corrected Petition for Inter Partes Review of U.S. Pat. No. 8,539,897, filed Jul. 9, 2014.
Patent Owner Malibu Boats' Preliminary Response to Nautique's Petition for Inter Partes Review of U.S. Pat. No. 8,539,897, filed Sep. 26, 2014.
Decision of Institution of Inter Partes Review of U.S. Pat. No. 8,539,897, dated Nov. 26, 2014.
Petitioner's Request for Rehearing, dated Dec. 5, 2014.
Order Denying Petitioner's Request for Rehearing, dated Dec. 23, 2014.
Expert Declaration of Robert K. Taylor, dated Jun. 25, 2014 in Inter Partes Review of U.S. Pat. No. 8,539,897.
Expert Report of Kevin Breen [Redacted Version] (pp. 1-434), dated Nov. 21, 2014 in *Malibu Boats, LLC* v. *Nautique Boat Co.*, Case No. 3:13-cv-00656, in the United States District Court for the Eastern District of Tennessee.
Expert Report of Kevin Breen [Redacted Version] (pp. 435-654), dated Nov. 21, 2014 in *Malibu Boats, LLC* v. *Nautique Boat Co.*, Case No. 3:13-cv-00656, in the United States District Court for the Eastern District of Tennessee.
Rebuttal Expert Report of Kevin Breen [Redacted Version], dated Dec. 12, 2014 in *Malibu Boats, LLC* v. *Nautique Boat Co.*, Case No. 3:13-cv-00656, in the United States District Court for the Eastern District of Tennessee.
Transcript of Deposition of Kevin C. Breen [Redacted Version], dated Dec. 18, 2014 in *Malibu Boats, LLC* v. *Nautique Boat Co.*, Case No. 3:13-cv-00656, in the United States District Court for the Eastern District of Tennessee.
Transcript of Deposition of Daniel Gasper [Redacted Version], dated Oct. 8, 2014 in *Malibu Boats, LLC* v. *Nautique Boat Co.*, Case No. 3:13-cv-00656, in the United States District Court for the Eastern District of Tennessee.
Transcript of Deposition of Adam Andrew McCall [Redacted Version], dated Dec. 3, 2014 in *Malibu Boats, LLC* v. *Nautique Boat Co.*, Case No. 3:13-cv-00656, in the United States District Court for the Eastern District of Tennessee.
Transcript of Deposition of Jack Springer [Redacted Version], dated Nov. 13, 2014 in *Malibu Boats, LLC* v. *Nautique Boat Co.*, Case No. 3:13-cv-00656, in the United States District Court for the Eastern District of Tennessee.
Transcript of 30(b)(6) Deposition of Jack Springer [Redacted Version], dated Nov. 14, 2014 in *Malibu Boats, LLC* v. *Nautique Boat Co.*, Case No. 3:13-cv-00656, in the United States District Court for the Eastern District of Tennessee.
Transcript of Deposition of Wayne Wilson [Redacted Version], dated Nov. 12, 2014 in *Malibu Boats, LLC* v. *Nautique Boat Co.*, Case No. 3:13-cv-00656, in the United States District Court for the Eastern District of Tennessee.
Transcript of Deposition of Scott Davenport [Redacted Version], dated Dec. 3, 2014 in *Malibu Boats, LLC* v. *Nautique Boat Co.*, Case No. 3:13-cv-00656, in the United States District Court for the Eastern District of Tennessee.
Malibu's Complaint for Patent Infringement, filed Jun. 29, 2015 in *Malibu Boats, LLC* v. *MasterCraft Boat Company, LLC*, Case No. 3:15-cv-00276 in the Eastern District of Tennessee.

* cited by examiner

SURF WAKE SYSTEM FOR A WATERCRAFT

CROSS-REFERENCE TO RELATED APPLICATIONS

This application is a continuation of U.S. patent application Ser. No. 13/830,799, filed Mar. 14, 2013, and titled SURF WAKE SYSTEM FOR A WATERCRAFT, which is a continuation of U.S. patent application Ser. No. 13/545,969, filed Jul. 10, 2012, and titled SURF WAKE SYSTEM FOR A WATERCRAFT, which claims the benefit under 35 U.S.C. §119(e) of U.S. Provisional Patent Application No. 61/559,069, filed Nov. 12, 2011, and titled SURF WAKE SYSTEM FOR A WATERCRAFT. U.S. patent application Ser. No. 13/830,799 is also a continuation-in-part of International Patent Application No. PCT/US2012/055788, with an international filing date of Sep. 17, 2012, titled SURF WAKE SYSTEM AND METHOD FOR A WATERCRAFT, which claims the benefit under 35 U.S.C. §119(e) of U.S. Provisional Patent Application No. 61/535,438, filed on Sep. 16, 2011 and titled SURF WAKE SYSTEM AND METHOD FOR A WATERCRAFT. Each of the above-identified patent applications is hereby incorporated by reference in its entirety and is made a part of this specification for all that it discloses.

BACKGROUND

1. Field of the Disclosure

This application relates, in general, to a wake system for a watercraft, and more particularly, to a surf wake system for modifying a wake produced by a watercraft travelling through water.

2. Description of the Related Art

Wake surfing has become increasingly popular in recent years because, unlike an ocean wave, a wake produced by a watercraft is on-demand not to mention continuous and endless as long as the watercraft is moving forward. As a watercraft travels through water, the watercraft displaces water and thus generates waves including bow wave and diverging stern waves on both sides of the watercraft. Due to pressure differences, these waves generally converge in the hollow formed behind the traveling watercraft and/or interfere with each other to form a wake behind the watercraft. Such a wake, however, is generally small, choppy or too close to the watercraft to be suitable and safe for water sports, and particularly not suitable for wake boarding or surfing.

To facilitate surfing, a wake should be formed away from the stern of the watercraft, for example, about ten feet away, and with a waist-height peak, for example, about three feet or higher. Generally hundreds, and sometimes thousands, of pounds of additional weight or ballast to a rear corner of the watercraft to make the watercraft tilt to one side, displaces more water, and hence generates a larger wake on that side. Such additional weight may be in the form of removable ballast bags, installed ballast tanks or bladders, or passengers positioned to one side of the watercraft, which is primarily used to tip the watercraft to that side. Using such additional weight to produce larger wakes, however, poses several disadvantages. For example, such additional weight may take up significant space and capacity that may otherwise reduce the passenger capacity of the watercraft. Also, such additional weight may unbalance the watercraft creating difficulties in control. Moreover, the additional weight generally must be moved from one side of the water craft to the other in order to generate a wake on the other side of the water craft. Shifting such additional weight may require significant time and effort. For example, filling and emptying ballast tanks to switch from one side to the other may require 20 minutes or more.

Alternatively, it is known to require extensive modification to a boat hull to promote a proper surf wake. An exemplar of generating a larger wake can be found in a U.S. Pat. No. 6,105,527 to Lochtefeld et al.

In light of the foregoing, it would therefore be useful to provide surf wake system that overcomes the above and other disadvantages.

SUMMARY

One aspect of the present invention is directed to a surf wake system for modifying a wake formed by a watercraft travelling through water. The surf wake system may include a pair of upright water diverters including a port diverter and a starboard diverter, each independently movable from a neutral position to a deployed position in which a respective water diverter extends outboard of a transom of the watercraft to deflect water traveling along a hull of the watercraft and past the transom. Positioning the port diverter in its deployed position while the starboard diverter is in its neutral position modifies the wake to provide a starboard surf wake, and positioning the starboard diverter in its deployed position while the port diverter is in its neutral position modifies the wake to provide a port surf wake.

In the deployed position, the respective water diverter may extend outboard beyond a side strake of the watercraft to deflect water traveling along the side strake and past the transom.

Each upright water diverter may be pivotally mounted to the watercraft adjacent the transom or a respective side strake.

Each upright water diverter may be pivotally mounted to directly to the transom or a respective side strake.

The surf wake system may include a plurality of positioners operably connected to a respective water diverter for positioning the respective water diverter relative to a longitudinal axis of the watercraft.

At least one of the plurality of positioners may be a linear actuator configured to selectively move a respective water diverter between its neutral and extended positions.

Another aspect of the present invention is directed to a surf wake system including a flap for deflecting water traveling past a transom of the watercraft, a hinge for pivotally mounting the flap relative to the watercraft, the hinge having a pivot axis extending adjacent and along a side edge of the transom, and a positioner operably connected to the flap for positioning the flap relative to a longitudinal axis of the watercraft between a neutral position and an outward position.

The flap may include a substantially planar member.

The flap may be approximately 10-15 inches high and approximately 15-20 inches long.

The flap may be formed of plastic, stainless steel, wood and/or fiberglass.

The hinge may be a jointed device having a first member pivotally affixed to a second member by a pin, wherein the first member is affixed to the watercraft and the second member is affixed to the flap.

The second member may be monolithically formed with the flap.

The actuator may be dimensioned and configured to pivotally move and position the flap between the neutral position, in which the flap pulls inboard, and the extended position, in which the flap extends outboard.

The flap may extend outboard at least approximately 5-15° relative to a longitudinal axis of the watercraft.

The surf wake system may include a manual actuator to selectively position the flap.

The surf wake system may include a controller installed within the watercraft and operably connected to the actuator to selectively position the flap.

The controller may include a display panel for displaying an indication of a position of the flap.

The surf wake system may include a plurality of flaps and hinges, each flap pivotally mounted to the watercraft by a respective hinge.

The plurality of flaps may include a port flap and a starboard flap, each mounted adjacent respective port side and starboard side edges.

The positioner may include a plurality of actuators each secured on the watercraft and operably connected to a respective one of the plurality of flaps.

The surf wake system may include a controller installed within the watercraft and operably connected to the plurality of the actuators to selectively position the plurality of the flaps.

In various embodiments, positioning the port flap in the outward position and the starboard flap in the neutral position enhances a right surf wake, and wherein positioning the starboard flap in the outward position and the port flap in the neutral position enhances a left surfing wake.

The methods and apparatuses of the present invention have other features and advantages which will be apparent from or are set forth in more detail in the accompanying drawings, which are incorporated herein, and the following Detailed Description, which together serve to explain certain principles of the present invention.

Various embodiments can relate to an inboard water-sports boat can include a hull having a transom, the hull housing an engine configured to propel the hull through water to produce a wake having eventually diverging port and starboard waves; a ballast system configured to add and remove water ballast (e.g., reference number 69 in FIG. 3); a rudder (e.g., reference number 71 in FIG. 10) responsive to a steering mechanism to steer the inboard water-sports boat as the hull moves through water; a surf system configurable by an operator purposefully selecting which of the port wave and the starboard wave to enhance to improve surfing thereon. The surf system can include a port-side deployable element movable between a deployed position and an at least substantially retracted position, wherein at least a portion of the port-side deployable element is configured to redirect water flowing along a port side of the hull when in the deployed position; a starboard-side deployable element movable between a deployed position and an at least substantially retracted position, wherein at least a portion of the starboard-side deployable element is configured to redirect water flowing along a starboard side of the hull when in the deployed position; a first positioner configured to hold the port-side deployable element in the deployed position when the port-side deployable element is in the deployed position, wherein the first positioner comprises a manual actuator positioned rearward of the transom such that the manual actuator is manually adjustable by a user manually manipulating the manual actuator of the first positioner at a location rearward of the transom to position the port-side deployable element at the deployed position; and a second positioner configured to hold the starboard-side deployable element in the deployed position when the starboard-side deployable element is in the deployed position, wherein the second positioner comprises a manual actuator positioned rearward of the transom such that the manual actuator is manually adjustable by a user manually manipulating the manual actuator of the second positioner at a location rearward of the transom to position the starboard-side deployable element at the deployed position. When a rider desires to surf on the port wave, the surf system is configured to enhance the port wave to have a face that is substantially smoother than a face of the starboard wave by positioning the starboard-side deployable element and the port-side deployable element in a first configuration, and wherein when the rider desires to surf on the starboard wave, the surf system is configured to enhance the starboard wave to have a face that is substantially smoother than a face of the port wave by positioning the starboard-side deployable element and the port-side deployable element in a second configuration.

The first positioner can include a pin configured to selectively engage a plurality of holes to selectively position the port-side deployable element at the at least substantially retracted position and the deployed position, and the second positioner can include a pin configured to selectively engage a plurality of holes to selectively position the starboard-side deployable element at the at least substantially retracted position and the deployed position. The first positioner can be configured to position the port-side deployable element at one or more interim positions between the at least substantially retracted position and the deployed position, and the second positioner can be configured to position the starboard-side deployable element at one or more interim positions between the at least substantially retracted position and the deployed position. The inboard water-sports boat can include a remote configured to enable a rider to control the wake. The inboard water-sports boat can be configured to change from enhancing the starboard wave to enhancing the port wave or from enhancing the port wave to enhancing the starboard wave without reconfiguring the water ballast in the ballast system. The inboard water-sports boat is configured to enhance the port wave or the starboard wave without significant leaning of the inboard water-sports boat to a port or starboard side. The port-side deployable element can pivot between the at least substantially retracted position and the deployed position, and the starboard-side deployable element can pivot between the at least substantially retracted position and the deployed position. The port-side deployable element can slide between the at least substantially retracted position and the deployed position, and the starboard-side deployable element can slide between the at least substantially retracted position and the deployed position. Each of the port-side deployable element and the starboard-side deployable element can include at least one of a water diverter, a wake modifier, a flap, and a plate. The starboard-side deployable element in the deployed position while the port-side deployable element is in the at least substantially retracted position can be configured to enhance the port wave to have a face that is substantially smoother than a face of the starboard wave, and the port-side deployable element in the deployed position while the starboard-side deployable element is in the at least substantially retracted position can be configured to enhance the starboard wave to have a face that is substantially smoother than a face of the port wave. The port-side deployable element can be an upright deployable element, and the starboard-side deployable element can be an upright deployable element.

Various embodiments can relate to a wake surf system for use with an inboard water-sports boat that is configured to produce a wake having eventually diverging port and starboard waves, wherein the wake surf system configurable by an operator purposefully selecting which of the port wave and the starboard wave to enhance to improve surfing thereon. The wake surf system can include a port-side deployable element configured to be pivotally coupled to an inboard water-sports boat hull proximate a transom, wherein the portside deployable element is configured to pivot between an at least substantially retracted position and a deployed position, and wherein the port-side deployable element is configured such that at least a portion of the port-side deployable element redirects a flow of water along the port side of the hull proximate the transom when in the deployed position; a first positioner comprising a manual actuator positioned proximate the transom that is configured to be manually adjustable by a user manually manipulating the manual actuator of the first positioner at a location proximate the transom to move the port-side deployable element between the at least substantially retracted position and the deployed position; a starboard-side deployable element configured to be pivotally coupled to the inboard water-sports boat hull proximate the transom, wherein the starboard-side deployable element is configured to pivot between an at least substantially retracted position and a deployed position, and wherein the starboard-side deployable element is configured such that at least a portion of the starboard-side deployable element redirects a flow of water along the starboard side of the hull proximate the transom when in the deployed position; and a second positioner comprising a manual actuator positioned proximate the transom that is configured to be manually adjustable by a user manually manipulating the manual actuator of the first positioner at a location proximate the transom to move the starboard-side deployable element between the at least substantially retracted position and the deployed position.

An inboard water-sports boat can include the wake surf system and can further include a hull including a transom, the hull housing an engine configured to propel the hull through water to produce a wake having eventually diverging port and starboard waves; a ballast system configured to add and remove water ballast; and a rudder responsive to a steering mechanism to steer the hull when the hull is propelled through water. The port-side deployable element can be pivotally coupled to the inboard water-sports boat hull proximate the transom such that at least the portion of the port-side deployable element extends at least laterally into the flow of water when in the deployed position, and the starboard-side deployable element can be pivotally coupled to the inboard water-sports boat hull proximate the transom such that at least the portion of the starboard-side deployable element extends at least laterally into the flow of the water when in the deployed position. The inboard water-sports boat can be configured to enhance the starboard wave to have a face that is substantially smoother than a face of the port wave when the inboard water-sports boat travels through water at a speed suitable for surfing with the port-side deployable element in the deployed position and with the starboard-side deployable element in the at least substantially retracted position, and the inboard water-sports boat can be configured to enhance the port wave to have a face that is substantially smoother than a face of the starboard wave when the inboard water-sports boat travels through water at the speed suitable for surfing with the starboard-side deployable element in the deployed position and with the port-side deployable element in the at least substantially retracted position. The inboard water-sports boat can be configured to change from enhancing the starboard wave to enhancing the port wave or from enhancing the port wave to enhancing the starboard wave without adjusting the water ballast in the ballast system. The inboard water-sports boat can be configured to enhance the starboard wave without significant leaning of the inboard water-sports boat to the starboard side and to enhance the port wave without significant leaning of the inboard water-sports boat to the port side. The first positioner can include a pin configured to selectively engage a plurality of holes to selectively position the port-side deployable element at the at least substantially retracted position and the deployed position, and wherein the second positioner comprises a pin configured to selectively engage a plurality of holes to selectively position the starboard-side deployable element at the at least substantially retracted position and the deployed position. The first positioner can be configured to position the port-side deployable element at one or more interim positions between the at least substantially retracted position and the deployed position, and the second positioner can be configured to position the starboard-side deployable element at one or more interim positions between the at least substantially retracted position and the deployed position. The port-side deployable element can be an upright deployable element, and the starboard-side deployable element can be an upright deployable element.

Various embodiments can relate to an inboard water-sports boat that can include a hull having a transom, the hull housing an engine configured to propel the hull through water to produce a wake having eventually diverging port and starboard waves; a ballast system configured to add and remove water ballast; a rudder responsive to a steering mechanism to steer the inboard water-sports boat as the hull moves through water; a surf system configurable by an operator purposefully selecting which of the port wave and the starboard wave to enhance to improve surfing thereon. The surf system can include a port-side deployable element movable between a deployed position and an at least substantially retracted position, wherein at least a portion of the port-side deployable element is configured to redirect water flowing along a port side of the hull when in the deployed position; a starboard-side deployable element movable between a deployed position and an at least substantially retracted position, wherein at least a portion of the starboard-side deployable element is configured to redirect water flowing along a starboard side of the hull when in the deployed position; a first positioner configured to hold the port-side deployable element in the deployed position when the port-side deployable element is in the deployed position, wherein the first positioner comprises a first pin configured to selectively engage a first hole while being disengaged from a second hole to position the port-side deployable element at the at least substantially retracted position and to selectively engage the second hole while being disengaged from the first hole to position the port-side deployable element at the deployed position; and a second positioner configured to hold the starboard-side deployable element in the deployed position when the starboard-side deployable element is in the deployed position, wherein the second positioner comprises a second pin configured to selectively engage a third hole while being disengaged from a fourth hole to position the starboard-side deployable element at the at least substantially retracted position and to selectively engage the fourth hole while being disengaged from the third hole to position the starboard-side deployable element at the deployed position. When a rider desires to surf on the port wave, the surf system can be configured to enhance the port wave to have a face that is substantially smoother than a face of the starboard wave by positioning the starboard-side deployable element and the port-side deployable element in a first configuration, and when the rider desires to surf on the starboard wave, the surf system can be configured to enhance the starboard wave to have a face that is substantially smoother than a face of the port wave by positioning the starboard-side deployable element and the port-side deployable element in a second configuration.

The first positioner can be manually adjustable by a user manually manipulating the first positioner at a location rearward of the transom, and the second positioner can be manually adjustable by a user manually manipulating the second positioner at a location rearward of the transom. The first positioner can be configured to position the port-side deployable element at one or more interim positions between the at least substantially retracted position and the deployed position, and second positioner can be configured to position the starboard-side deployable element at one or more interim positions between the at least substantially retracted position and the deployed position. The inboard water-sports boat can be configured to change from enhancing the starboard wave to enhancing the port wave or from enhancing the port wave to enhancing the starboard without reconfiguring the water ballast in the ballast system. The inboard water-sports boat can be configured to enhance the port wave or the starboard wave without significant leaning of the inboard water-sports boat to a port or starboard side. The port-side deployable element can pivot between the at least substantially retracted position and the deployed position, and the starboard-side deployable element can pivot between the at least substantially retracted position and the deployed position. The port-side deployable element can slide between the at least substantially retracted position and the deployed position, and the starboard-side deployable element can slide between the at least substantially retracted position and the deployed position. The starboard-side deployable element in the deployed position while the port-side deployable element is in the at least substantially retracted position can be configured to enhance the port wave to have a face that is substantially smoother than a face of the starboard wave, and the port-side deployable element in the deployed position while the starboard-side deployable element is in the at least substantially retracted position cam be configured to enhance the starboard wave to have a face that is substantially smoother than a face of the port wave. The port-side deployable element can be an upright deployable element, and the starboard-side deployable element can be an upright deployable element.

Various embodiments can relate to a wake surf system for use with an inboard water-sports boat that is configured to produce a wake having eventually diverging port and starboard waves. The wake surf system can be configurable by an operator purposefully selecting which of the port wave and the starboard wave to enhance to improve surfing thereon. The wake surf system can include a port-side deployable element configured to be pivotally coupled to an inboard water-sports boat hull proximate a transom, wherein the port-side deployable element is configured to pivot between an at least substantially retracted position and a deployed position, and wherein the port-side deployable element is configured such that at least a portion of the port-side deployable element redirects a flow of water along the port side of the hull proximate the transom when in the deployed position; a first positioner that is manually adjustable to position the port-side deployable element at the at least substantially retracted position and at the deployed position, wherein the first positioner comprises a first pin configured to selectively engage a first hole while being disengaged from a second hole to position the port-side deployable element at the at least substantially retracted position and to selectively engage the second hole while being disengaged from the first hole to position the port-side deployable element at the deployed position; a starboard-side deployable element configured to be pivotally coupled to the inboard water-sports boat hull proximate the transom, wherein the starboard-side deployable element is configured to pivot between an at least substantially retracted position and a deployed position, and wherein the starboard-side deployable element is configured such that at least a portion of the starboard-side deployable element redirects a flow of water along the starboard side of the hull proximate the transom when in the deployed position; and a second positioner that is manually adjustable to position the starboard-side deployable element at the at least substantially retracted position and at the deployed position, wherein the second positioner comprises a second pin configured to selectively engage a third hole while being disengaged from a fourth hole to position the starboard-side deployable element at the at least substantially retracted position and to selectively engage the fourth hole while being disengaged from the third hole to position the starboard-side deployable element at the deployed position.

An inboard water-sports boat can include the wake surf system can also include a hull including a transom, the hull housing an engine configured to propel the hull through water to produce a wake having eventually diverging port and starboard waves; a ballast system configured to add and remove water ballast; and a rudder responsive to a steering mechanism to steer the hull when the hull is propelled through water. The port-side deployable element can be pivotally coupled to the inboard water-sports boat hull proximate the transom such that at least the portion of the port-side deployable element extends at least laterally into the flow of water when in the deployed position, and the starboard-side deployable element can be pivotally coupled to the inboard water-sports boat hull proximate the transom such that at least the portion of the starboard-side deployable element extends at least laterally into the flow of the water when in the deployed position. The inboard water-sports boat can be configured to enhance the starboard wave to have a face that is substantially smoother than a face of the port wave when the inboard water-sports boat travels through water at a speed suitable for surfing with the port-side deployable element in the deployed position and with the starboard-side deployable element in the at least substantially retracted position, and wherein the inboard water-sports boat is configured to enhance the port wave to have a face that is substantially smoother than a face of the starboard wave when the inboard water-sports boat travels through water at the speed suitable for surfing with the starboard-side deployable element in the deployed position and with the port-side deployable element in the at least substantially retracted position. The inboard water-sports boat can be configured to change from enhancing the starboard wave to enhancing the port wave or from enhancing the port wave to enhancing the starboard wave without adjusting the water ballast in the ballast system. The inboard water-sports boat is configured to enhance the starboard wave without significant leaning of the inboard water-sports boat to the starboard side and to enhance the port wave without significant leaning of the inboard water-sports boat to the port side. The first positioner can be configured to position the port-side deployable element at one or more interim positions between the at least substantially retracted position and the deployed position, and the second positioner can be configured to position the starboard-side deployable element at one or more interim positions between the at least substantially retracted position and the deployed position. The port-side deployable element can be an upright deployable element, and the starboard-side deployable element can be an upright deployable element.

DETAILED DESCRIPTION OF CERTAIN EMBODIMENTS

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Generally, the present invention relates to a surf wake system for a watercraft that is concerned with flow management of water passing the stern as the water craft is moving forward through a body of water, so that water is directed in such a manner to enhance size, shape and/or other characteristics the resulting wake of the watercraft. As will become apparent below, the surf wake system of the watercraft allows diversion of water passing along one side of the stern away from the usual converging area immediately behind the transom of the watercraft, so that the diverging water will enhance the resulting wake on the opposing side of the watercraft. In doing so, the surf wake system of the present invention allows the enhancement of wake without significant pitching or leaning of the watercraft to one side or the other.

Figure 1:
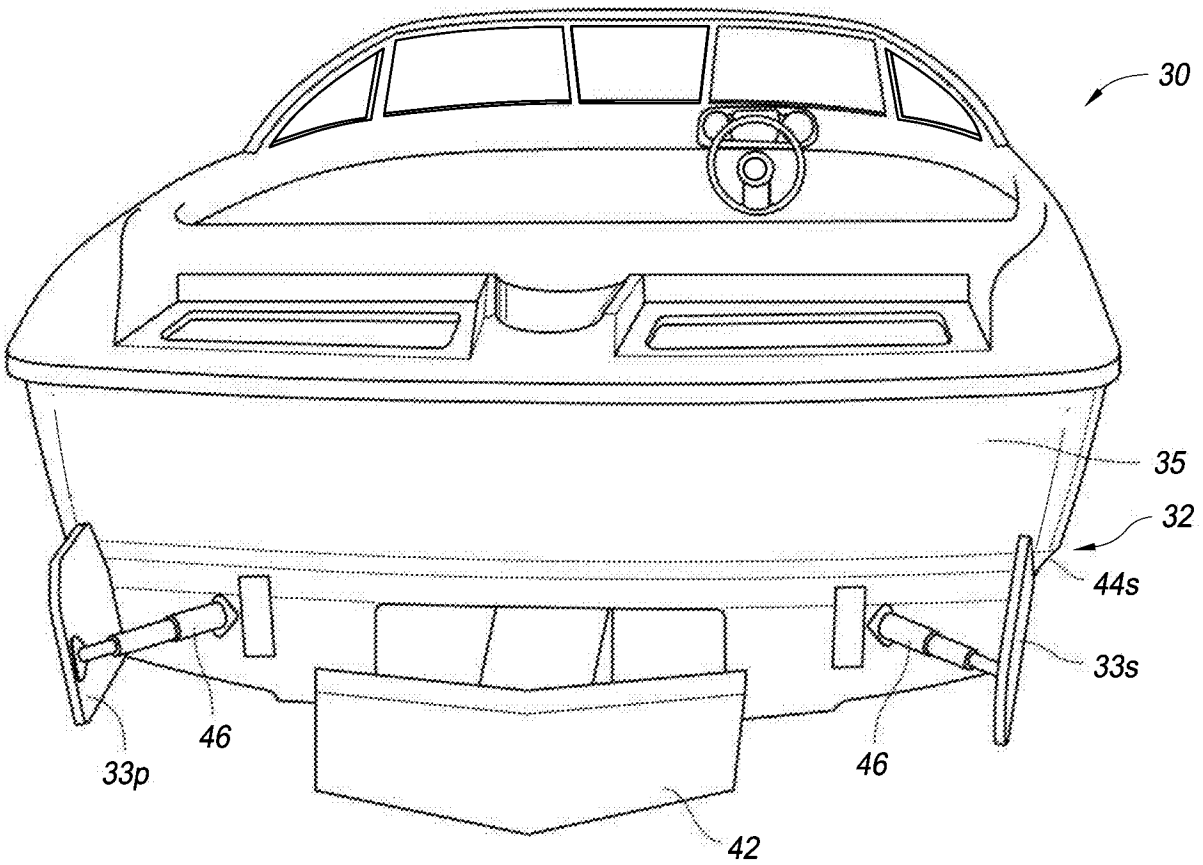
FIG. 1 is a rear perspective view of an exemplary surf wake system including a pair of flap assemblies in accordance with various aspects of the present invention.

Turning now to the drawings, wherein like components are designated by like reference numerals throughout the various figures, attention is directed to FIG. 1 which illustrates a watercraft 30 equipped a surf wake system 32 for modifying a wake formed by the watercraft travelling through water. Advantageously, the surf wake system may enhance surf wakes with or without supplemental ballast and thus it is possible to enhance wake with less watercraft lean. The surf wake system of the present invention in general includes one or more water diverters 33, each water diverter is adjustably mounted relative to the watercraft for deflecting water travelling past a transom 35 of the watercraft. Broadly, the water diverters are movably mounted with respect to transom 35.

In the illustrated embodiment, the water diverters are in the form of flaps 33, pivotally mounted on respective hinges 37, which have a pivot axis 39 extending adjacent and along a side edge 40 of the transom. Although the illustrated embodiment shows the flaps mounted directly on the transom, one will appreciate that the flaps may be moveably mounted directly or indirectly to the transom. For example, the flaps and associated hardware may be mounted on a removable swim platform or other structure that is mounted on or adjacent the transom.

As also shown in FIG. 1, watercraft 30 may be equipped with a wake-modifying device 42 to enhance the overall size of the wake formed by the watercraft. One such device is sold by Malibu Boats as the Power Wedge, which is similar to that described in U.S. Pat. No. 7,140,318, the entire content of which is incorporated herein for all purposes by this reference. Another such device may incorporate pivotal centerline fins of the type developed by Malibu Boats and described in U.S. Patent Application No. 61/535,438, the entire content of which is also incorporated herein for all purposes by this reference. One will appreciate that, while various other wake modifying devices may be very beneficial in enhancing the size and shape of a wake, such other wake modifying devices need not be used, nor is essential to be used, in combination with the surf wake system of the present invention. Similarly, one will appreciate that positioning extra weight or ballast adjacent the transom may also be very beneficial in enhancing the size of a wake, with or without the use of a wake modifying device, however, such weight or ballast need not be used, nor is essential to be used, in combination with the surf wake system of the present invention.

Figure 3:
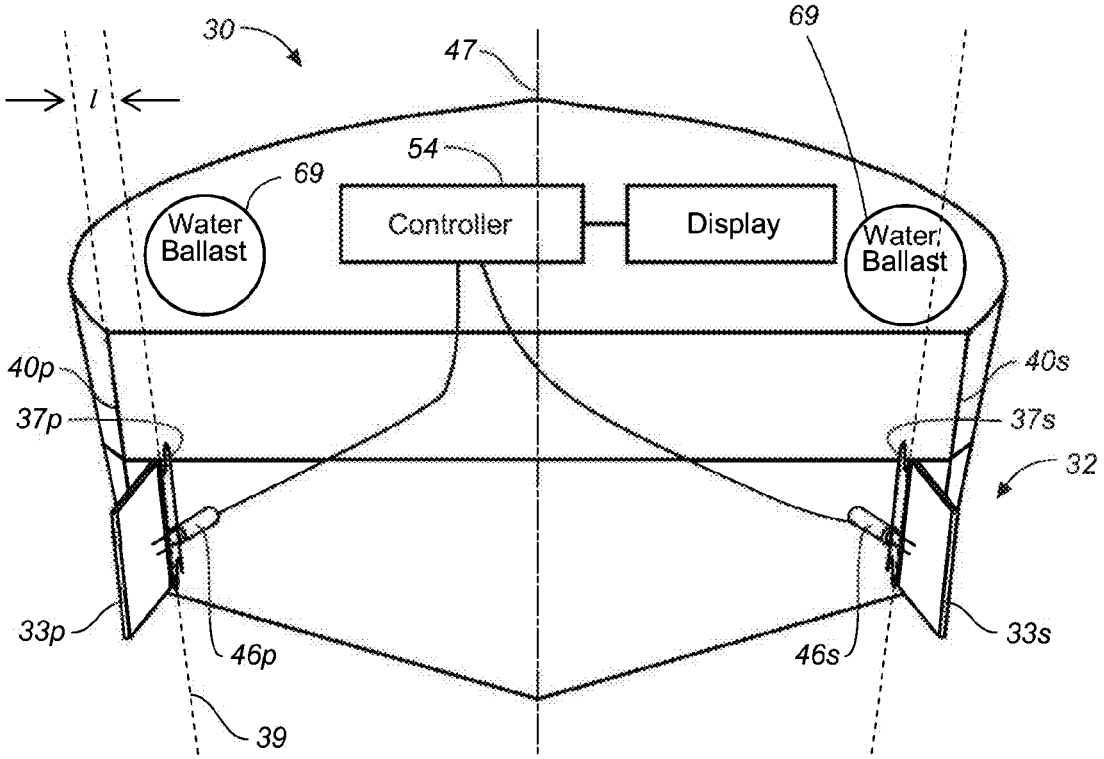
FIG. 3 is a schematic rear view of the exemplary surf wake system of FIG. 1.

Turning now to FIG. 3, a side edge is the intersection of the transom with either a port side strake 44*p* or a starboard side strake 44*s*, wherein the suffixes "p" and "s" represent features on the port side and the starboard side, respectively. Therefore, the intersection of the transom with the port side strake is referred to as the port side edge 40*p* and the intersection of the transom with the starboard side strake is referred to as the starboard side edge 40*s*. Accordingly, a port side flap 33*p* refers to a flap adjacent the port side edge, and a starboard side flap 33*s* refers to a flap adjacent the starboard side edge.

In general, a distance L between a respective pivot axis and the side edge is less than the longest dimension of the flap in order to allow the flap to extend parallel to the side strake of the hull or beyond. The distance is preferably less than 10-5 inches and more preferably less than 5 inches. That is, the flaps are positioned away from an imaginary center line or longitudinal axis of the watercraft and adjacent a respective port side or starboard side.

For illustration purposes, the pivot axis of the hinge shown in this application is drawn parallel to the corresponding side edge. One will appreciate that the pivot axis does not necessary need to be parallel to the corresponding side edge. One will also appreciate that the pivot axis may be substantially vertical, substantially parallel to the side edge, some other angle therebetween, or some angle slightly inclined with respect to the side edge. Preferably the angle between the pivot axis and the side edge is less than approximately 15°, more preferably less than 10°, and even more preferably less than 5°.

Figure 2:
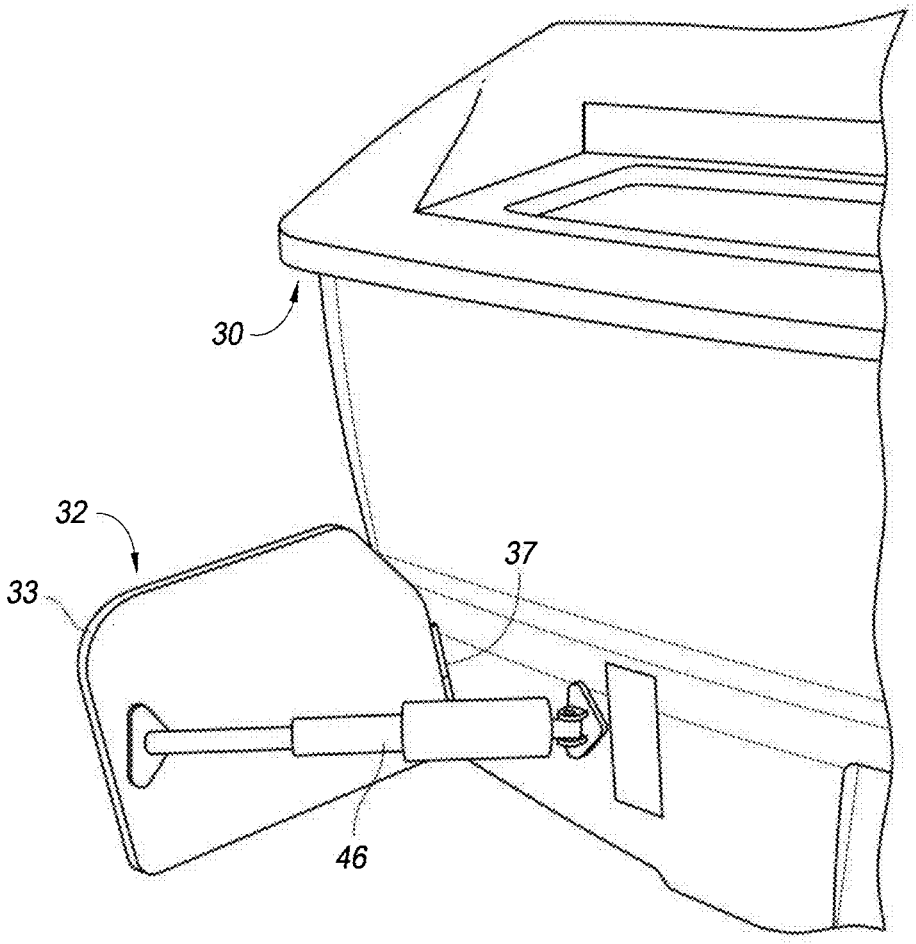
FIG. 2 is an enlarged perspective view of one of the flap assemblies of FIG. 1.

With reference to FIG. 1 and FIG. 2, the surf wake system also includes one or more positioners or actuators 46, each secured on the watercraft and operably connected to a respective flap 33. In the illustrated embodiment, the actuators are linear actuators including electric motors. However, one will appreciate that other suitable actuators may be employed to move the flaps, including hydraulic and pneumatic motors. Preferably the actuators are watertight or water resistant, and more preferably waterproof. The actuators are configured to pivot the flaps about their respective pivot axis and position the flaps in different positions, as will be discussed in greater detail below. One will also appreciate that manual actuators or positioners may be utilized to secure the flaps in a desired position.

In various embodiments, the actuators may be electric actuators of the type manufactured by Lenco Marine Inc. which include a linearly-extendable threaded rod assembly driven by a step motor. In various embodiments, the actuator may be configured to move between an inner retracted position and an outer extended position, while in other embodiments, the actuators are configured to also move to one or more interim positions, for example, every 5°, 10°, 15°, etc. By activating the actuator for predetermined periods of time, the actuator may be accurately and repeatedly controlled to move to the desired position. One will appreciate that the actuator may be configured to accommodate a wide variety of angular ranges as well as interim positions.

One will also appreciate that other actuators may be utilized in accordance with the present invention. For example, hydraulic and pneumatic actuators may be used, as well as manual actuators.

Figure 4A:
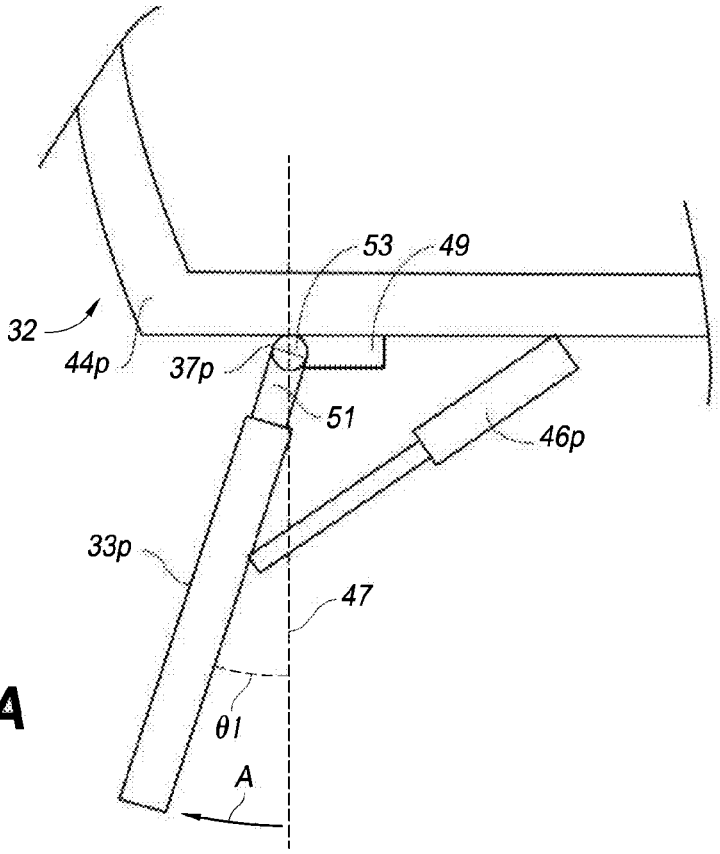
FIG. 4(*a*) and FIG. 4(*b*) are schematic views of the flap assembly of FIG. 2 in extended and retracted positions, respectively.
Figure 4B:
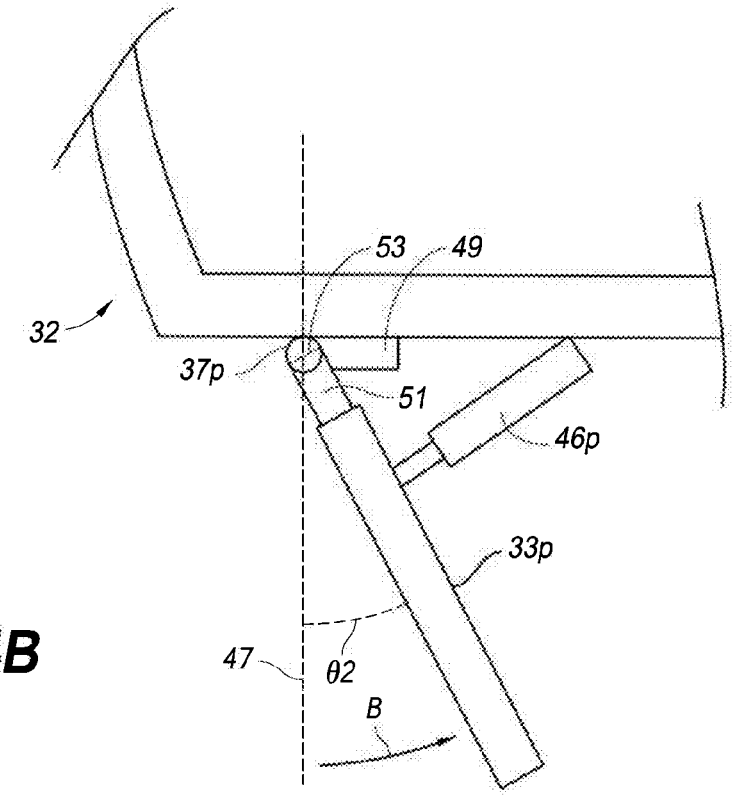

Turning now to FIG. 4(*a*) and FIG. 4(*b*), port side flap 33*p* is shown in two different positions, namely an outward position in FIG. 4(*a*) and a neutral position in FIG. 4(*b*). As illustrated, the flap in the outward position extends away from a longitudinal axis 47 of watercraft 30 as the flap moves in the direction illustrated by arrow A. In the illustrated embodiment, the flap and has at least a portion of the flap extending outwardly beyond the side strake and the transom. In the neutral position, the flap extends toward the center line as it moves in the direction illustrated by arrow B and is located behind the transom and inboard of the side strake 44*p*. In various embodiments of the present invention, the flap has an angle θ1 of approximately 0° to 45°, preferably between 5° to 30°, and more preferably 5° to 15° relative to the longitudinal axis of the watercraft when the flap extends to its outermost position, and has an angle θ2 of approximately 0 to −90°, preferably −15° to −30° relative to the longitudinal axis when the flap extends in its innermost position. One will also appreciate that the system may be configured to allow the flap to laterally extend beyond the side strake substantially perpendicular to the longitudinal axis of the watercraft in order to redirect and/or deflect water passing along the water craft as it moves beyond the transom. Alternatively, one will appreciate that the flap may extend parallel to the longitudinal axis to direct water straight back and prevent water from flowing directly behind the transom. While extending the flap beyond the side strake will likely delay convergence of water to a greater degree (as will become apparent below), extending the flap parallel to the longitudinal axis may sufficiently delay convergence of water to produce a desired waveform.

One will appreciate that the surf wake system of the present invention may be configured to hold the flaps in one or more interim positions between their respective outward and neutral positions. For example, the surf wake system may be configured to hold the flaps at 0°, 5°, 10°, 15°, 20°, 25°, 30° and etc. relative to the centerline. Such interim positions may allow the system to further modify or incrementally modify the resulting wake, and may thus accommodate surfer preferences. For example, such interim positions may more precisely shape the wake to accommodate for specific watercraft setup, watercraft speed, watercraft weight, passenger weight variances and distributions, and other variables to provide a desired wake shape and waveform. Moreover, a number of interim positions may optimize waveform for various other parameters such user preferences. For example, experienced surfers may prefer larger faster wakes, while novice surfers may want a smaller, slower manageable wake.

As a watercraft travels through water, the watercraft displaces water and generates waves including bow waves and diverging stern waves. Due to pressure differences and other phenomena, these waves generally converge in the hollow formed behind the watercraft and interfere with each other to form an otherwise conventional wake behind the watercraft, such as that shown in FIG. 6(*a*). As noted above, such a wake is generally small, choppy or too close to the watercraft to be suitable and safe for water sports, and particularly not suitable for wake surfing.

By moving a flap of the present invention to an outward position, however, water is redirected, which may lead to constructive interference to form a larger wake having a higher peak and a smoother face, which wake is conducive for surfing. In addition, the flap may redirect water so that the larger wake is formed further away from the watercraft, and thus creating a safer environment for surfing. Moreover, by placing the flaps along the side edges, the watercraft can generate a suitable surfing wake with less tilt or lean to one side, thus making the watercraft easier to control. One will appreciate that the flaps may enhance wake shape and size with or without the use of significant additional weight or ballast located toward the rear corners of the watercraft. Other advantages will become apparent later on in the description of the operation of the present invention.

In various embodiments of the present invention, the wake system may include one or more flap assemblies, for example, one or more port flap assemblies, and/or one or more starboard flap assemblies may be used. Preferably, the wake system is configured and positioned to have one flap and corresponding hinge immediately adjacent each of the port side edge and the starboard side edge.

In various embodiments of the present invention, the flap is a substantially planar member, as can be seen in FIG. 2. The flap is generally dimensioned and configured such that the top of the flap is located within the resting freeboard distance (i.e., the distance between the waterline and the gunwale) and will be located approximately at the waterline while the watercraft is at use accommodating for both watercraft speed and displacement with additional ballast and/or passenger weight.

In the illustrated embodiment, the flap is approximately 14 inches high, approximately 17 inches long and approximately ¾ inch thick. One will appreciate that the actual dimensions of the flap may vary. Preferably, the flap is approximately 10-18 inches high, approximately 12-22 inches long, and approximately ½ to 1¼ inches thick, and more preferably approximately 12-16 inches high, 15-19 inches long, and ¾ to 1 inch thick. One will appreciate that the deeper the flap extends below the waterline, the more water will be diverted.

In addition, one will appreciate that the flap need not be planar and its actual dimensions will vary depending on the size of the watercraft, the demand of the type of the wake and/or other factors. Other suitable configurations and sizes can be employed, including curved surfaces, curved edges, different geometric profiles, and/or different surface textures. The flap can be made of plastic, stainless steel, fiberglass, composites, and/or other suitable materials. For example, the flap may be formed of gelcoated fiberglass and/or stainless trim plate.

As shown in FIGS. 4(*a*)-4(*b*), in the illustrated embodiment, hinge 37, is a jointed device having a first hinge member 49 pivotally affixed to a second hinge member 51 by a pin 53. First member 49 is affixed to the watercraft and second member 51 is affixed to flap 33. One will appreciate that other hinge devices may be utilized. For example, the hinge may include a flexible member allowing relative pivotal motion instead of a pinned joint. In addition, various configurations may be utilized. For example, the second member may be monolithically formed with the flap.

Turning back to FIG. 3, wake system 32 may include a controller 54 that is operationally connected to actuators 46, of the wake system, which actuators selectively control the positions of respective flaps 33.

An exemplary method of operating the surf wake system in exemplary embodiments of the present invention will be explained with reference to FIGS. 5-8. A pair of flaps 33*p*, 33*s* with their respective hinges 37*p*, 37*s* and actuators 46*p*, 46*s* are installed on transom 35 of the watercraft adjacent respective side edges 40, one on the port side and the other on the starboard side of the watercraft. One will appreciate that the present invention is not limited to this specific configuration. The number of the flaps and the positions thereof can be varied as noted previously.

Figure 5A:
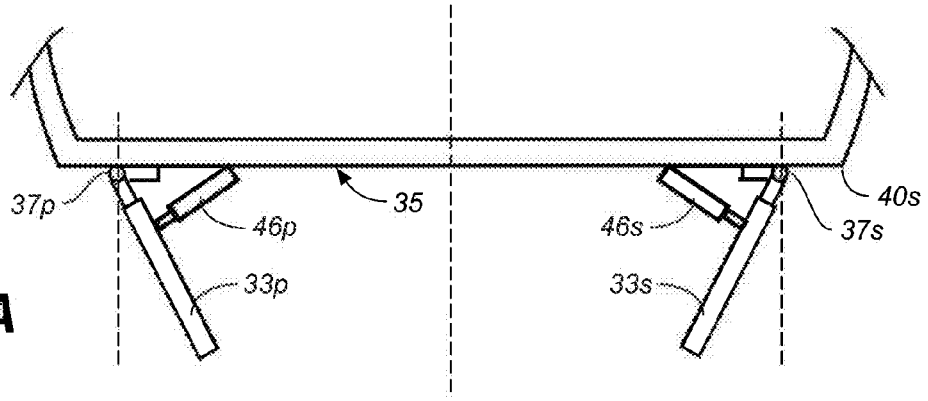
FIG. 5(*a*), FIG. 5(*b*) and FIG. 5(*c*) are schematic views of the exemplary surf wake system of FIG. 1 in which the flap assemblies are positioned for cruising, a starboard side surf wake, and a port side surf wake, respectively.
Figure 5B:
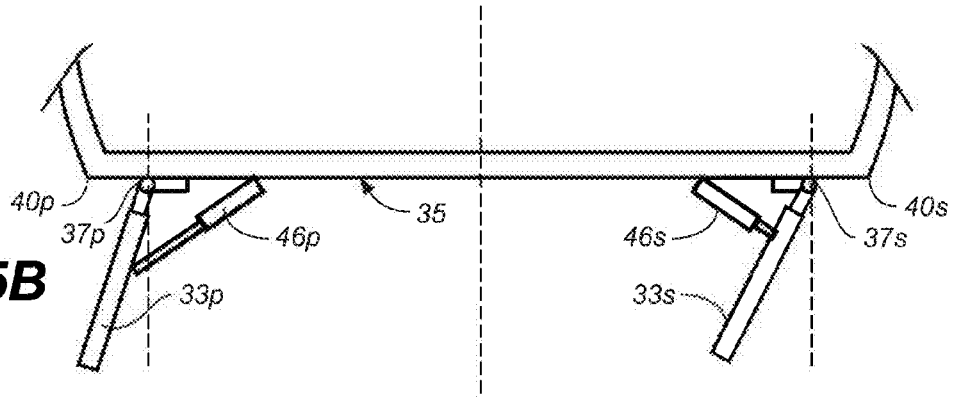
Figure 5C:
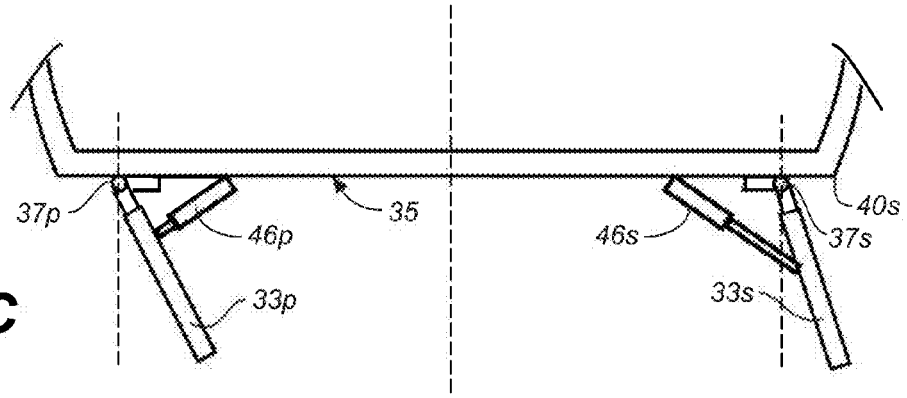
Figure 6A:
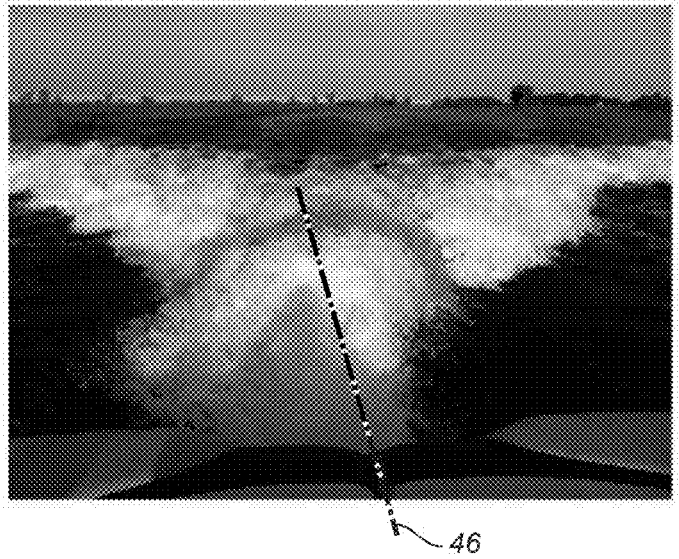
FIG. 6(*a*), FIG. 6(*b*) and FIG. 6(*c*) illustrate conventional, starboard surf, and port surf wakes, respectively, as produced by the surf wake system of FIG. 1.
Figure 6B:
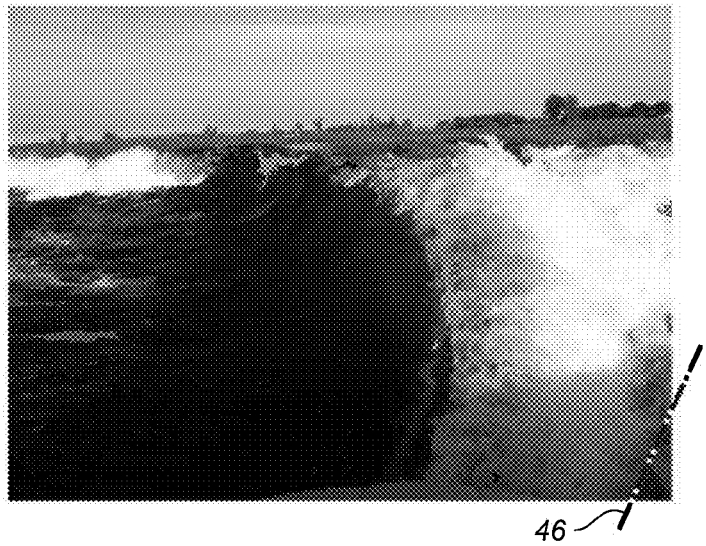
Figure 6C:
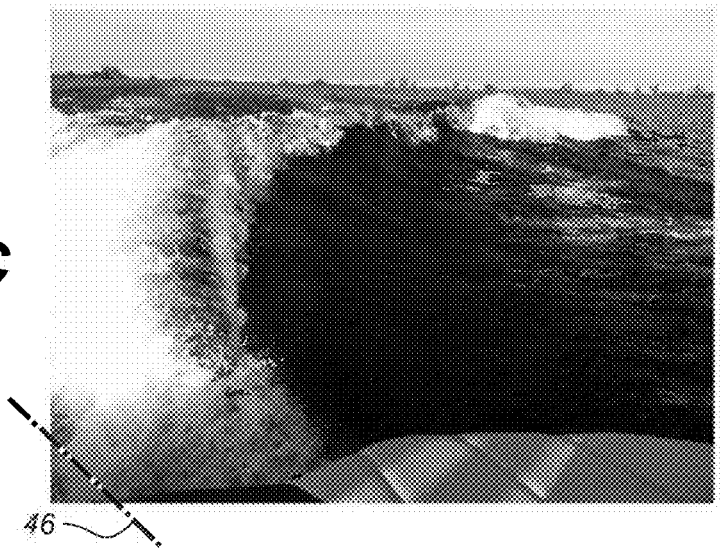

As shown in FIG. 5(*a*), both flaps are retracted and positioned in their neutral positions behind transom 35, and not extending outward or outboard form their respective port and starboard side strakes 44*p*, 44*s*. At such positions, the flaps in general do not interference with the waves generated by the watercraft travelling through water, and hence have no or negligible effects on the wake, and thus the flaps can be positioned in such configuration for cruising. As shown in FIG. 6(*a*), having the flaps positioned in the manner illustrated in FIG. 5(*a*) does not redirect water passing by the transom that thus produces an otherwise conventional wake, that is, one without a smooth face or a high peak, and is thus not suitable for surfing.

Turning to FIG. 5(*b*), when a starboard surf wake is desired, port side flap 33*p* is positioned in an outward position while the starboard side flap 33*s* remains in a neutral position. Since the port side flap is in an outward position and thus extends beyond the port side strake 44*p*, waves on the port side are redirected, which facilitates constructive interference of converging waves to form a larger starboard wake with a higher peak and smoother face that is suitable for starboard surfing, such as that shown in FIG. 6(*b*) Comparing to the non-enhanced wake of FIG. 6(*a*) with the starboard wake shown in FIG. 6(*b*), it is evident that surf wake system 32 modified and/or enhanced the wake with a smooth face and a relatively high peak. As can be seen in FIG. 6(*b*), waist-high peaks of three or four feet are attainable, thus providing a reproducible wake that is suitable for surfing.

Turning to FIG. 5(*c*), when a port side surf wake is desired, starboard side flap 33*s* is positioned in an outward position while the port side flap 33*p* remains in a neutral position. Now that the starboard side flap is in an outward position, a port side wake, such as that shown in FIG. 6(*c*) is produced in a manner similar to that described above. Such configuration produces a left side surf wake. Comparing to the non-enhanced wake of FIG. 6(*a*) with the port side wake shown in FIG. 6(*c*), it is evident that surf wake system 32 modified and/or enhanced the port side wake with a smooth face and a relatively high peak. As can be seen in FIG. 6(*c*), waist-high peaks of three or four feet are attainable, thus providing a reproducible wake that is suitable for surfing.

As noted before, the watercraft equipped with the surf wake system of the present invention can generate a suitable surfing wake with or without adding significant extra weight at a rear corner of the watercraft. As such, weight need not be moved from one side to another, and thus no significant shifting of the watercraft from one side to the other is not required, and thus there are no significant changes to the handling of the watercraft. The surf wake system of the present invention allows switching from a port side wake to a starboard wake, or vice versa, on demand or "on the fly" thus accommodating both regular (or natural) and goofy surfers, as well as surfers that are sufficiently competent to switch from a port side wake to a starboard wake while under way. To this end, the controller is preferably configured to allow operation of the actuators on-demand and on-the-fly.

In addition to modifying wakes for recreational purposes, the water diverters of the surf wake system may be activated for other purposes such as steering assist. For example, the port flap may be actuated to provide turning assist to the left at gear idle, and similarly the starboard flap actuated to provide turning assist to the right. Thus, with an appropriate flap extended, the watercraft may turn within a very small radius around a fallen skier, boarder or surfer. Also, it is sometimes difficult for inboard watercraft to turn to left while moving backwards, the flaps may be activated to assist in such maneuvering. One will appreciate that the control system may be configured to utilize input from the steering system and/or the drive system to determine an appropriate level of "turning assist". For example, the control system may be configured such that turning assist would only work below a predetermined speed, for example 7 mph. One will also appreciate that such turning assist may utilize controls that that are integrated into the surf wake system, or alternatively, such turning assist may utilize discrete controls to that are separately activated in accordance with the needs of turning assistance.

Figure 7:
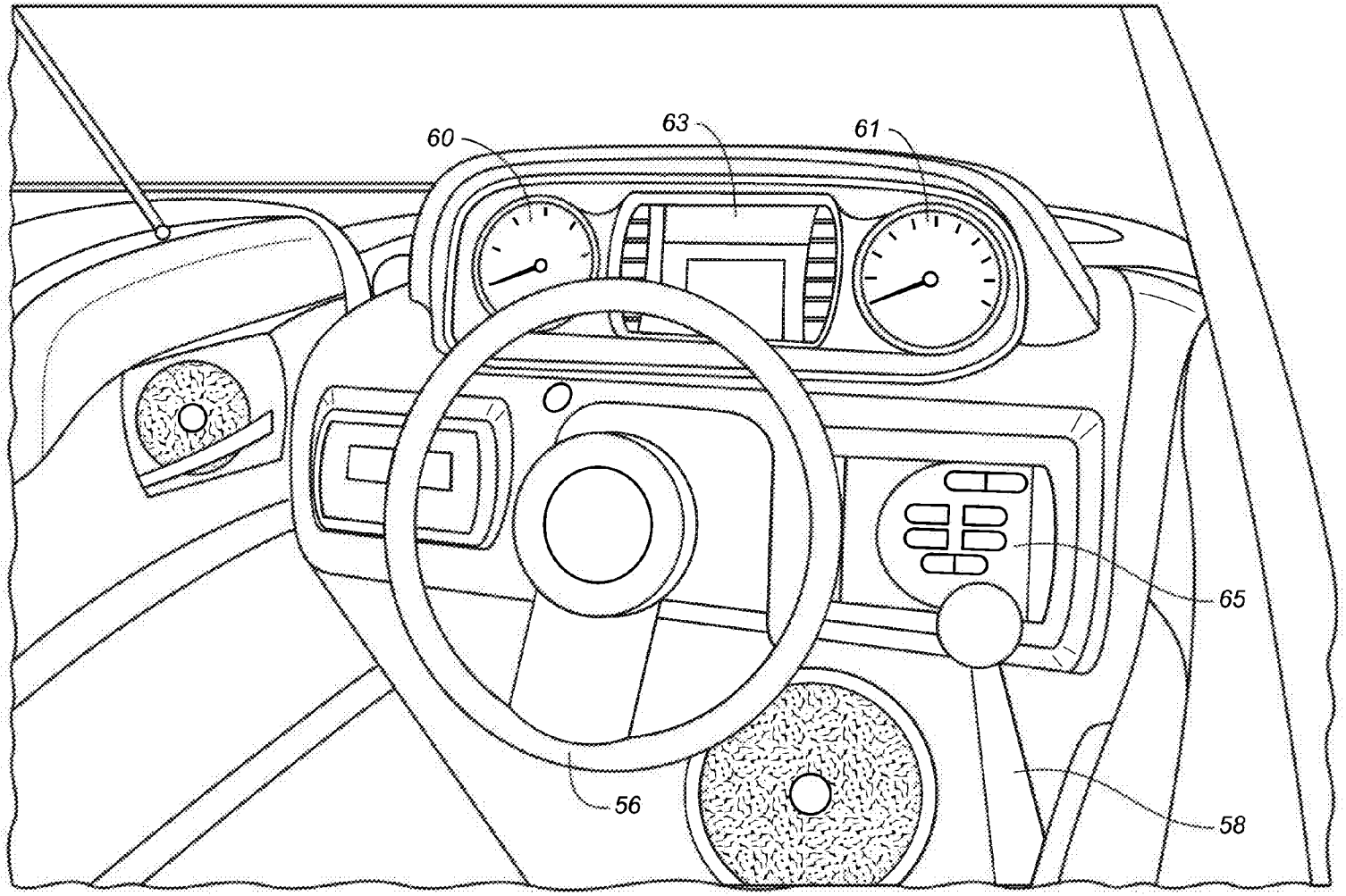
FIG. 7 is a perspective view of an exemplary cockpit of a watercraft incorporating a surf wake system including an input controller for operation of the surf wake system.
Figure 8A:
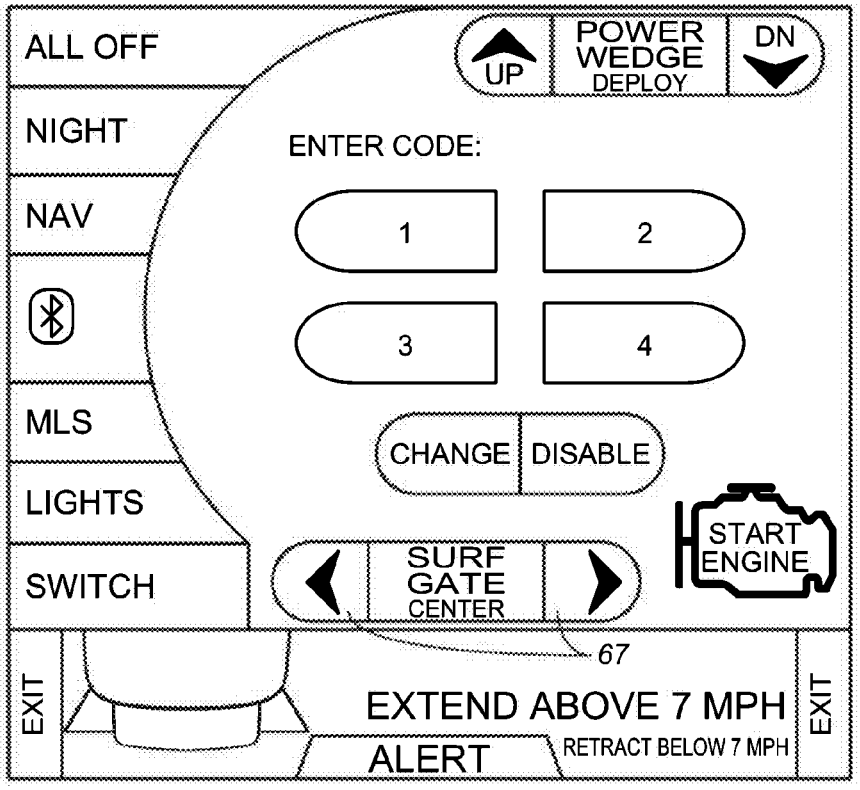
FIG. 8(*a*), FIG. 8(*b*), FIG. 8(*c*), FIG. 8(*d*), FIG. 8(*e*) and FIG. 8(*f*) are exemplary screen shots of the input controller of FIG. 7.
Figure 8B:
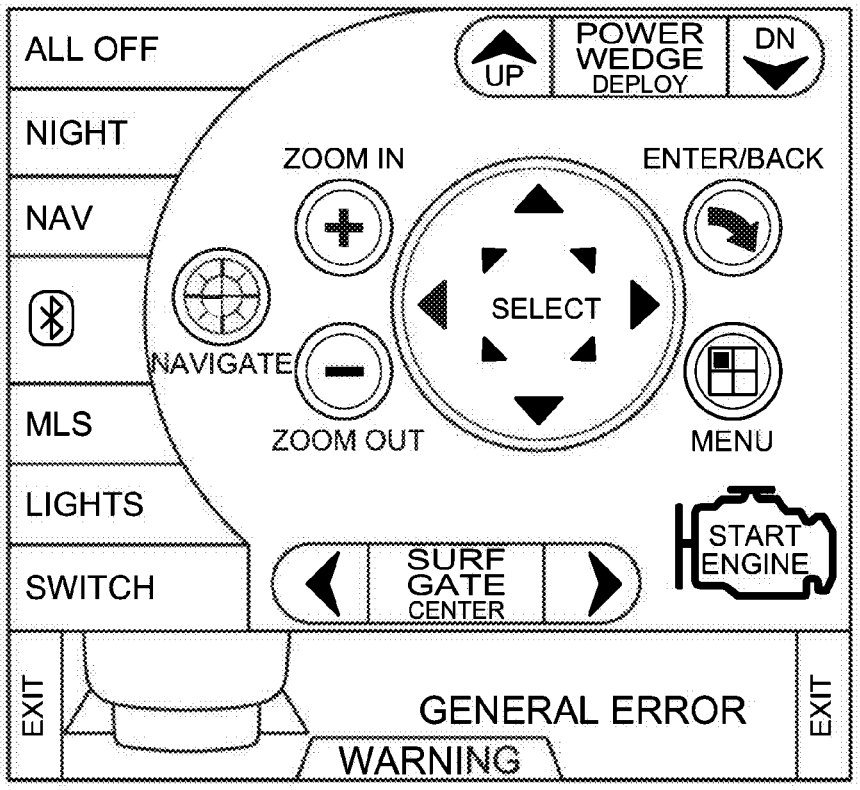
Figure 8C:
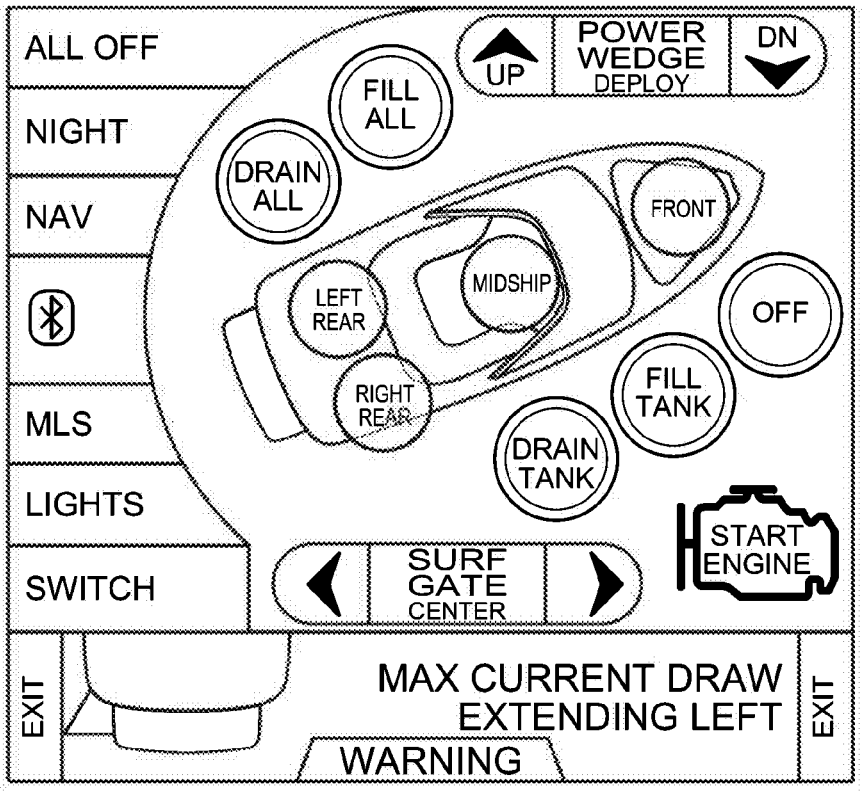
Figure 8D:
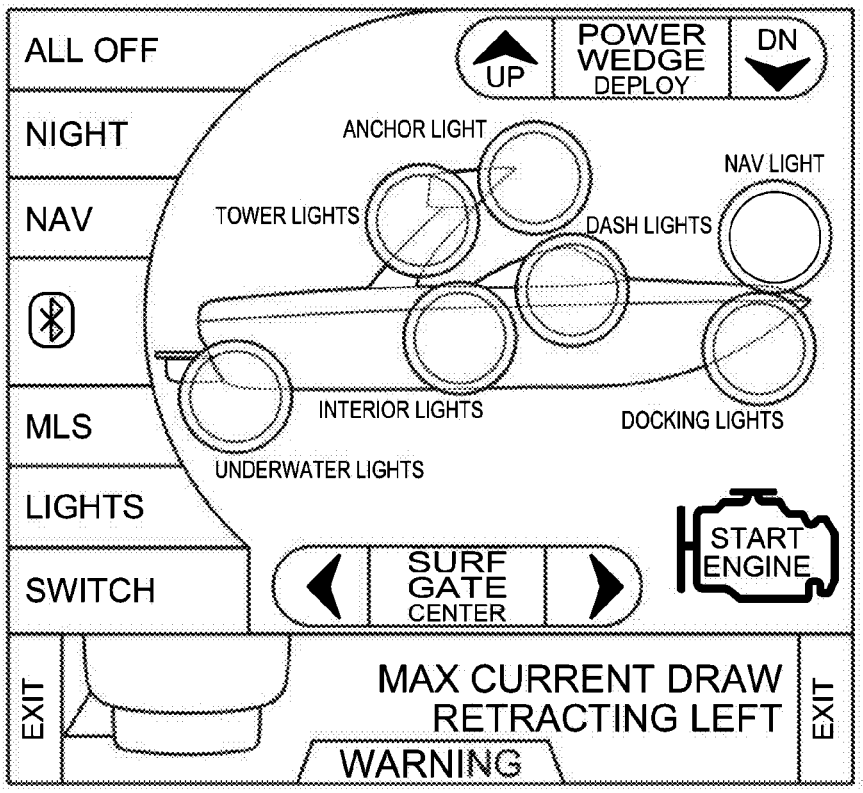
Figure 8E:
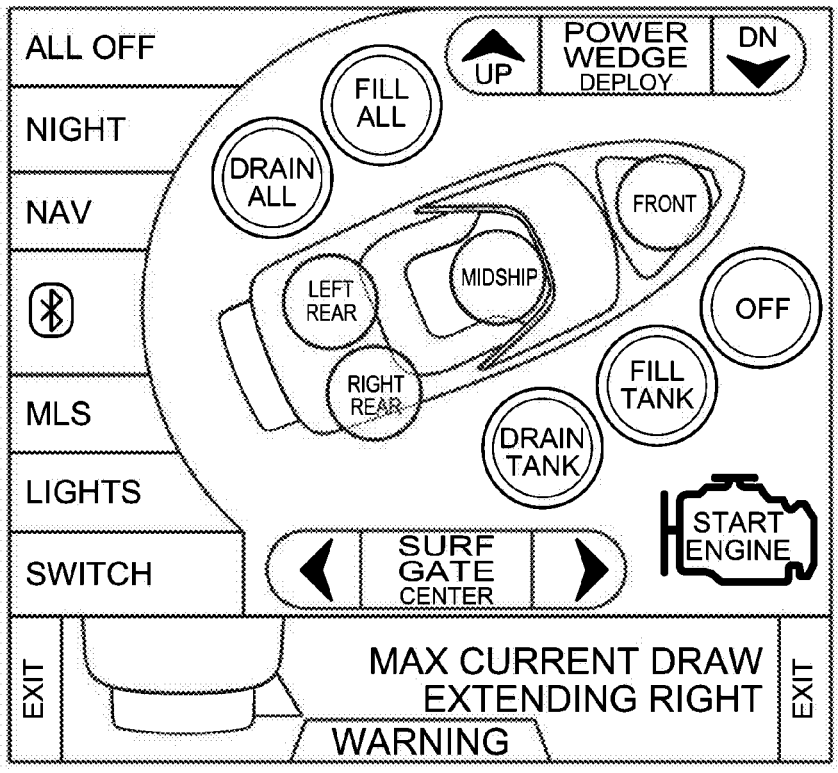
Figure 8F:
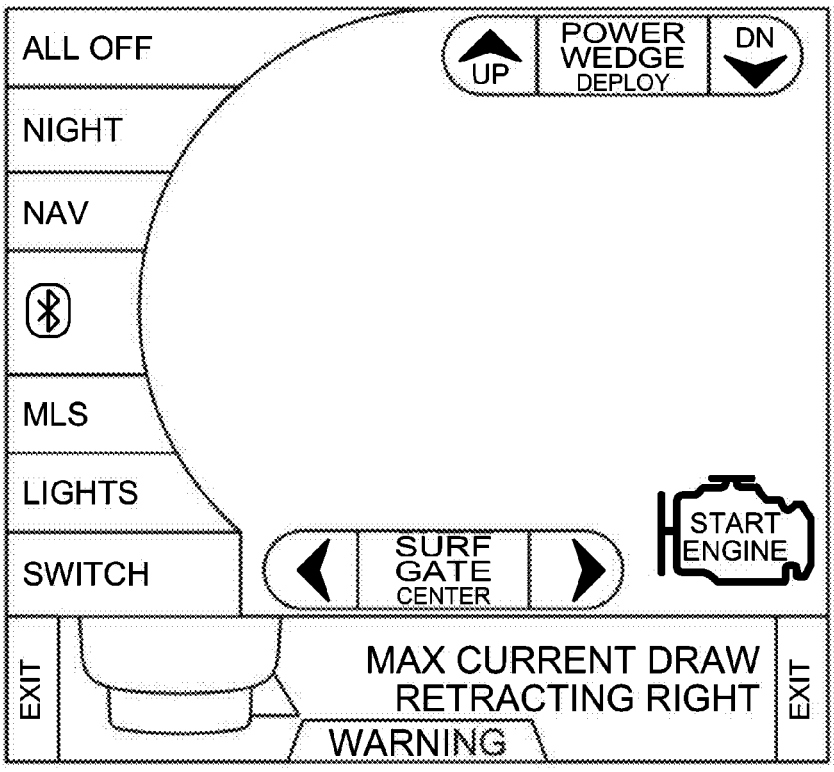

Turning now to FIG. 7, watercraft 30 includes an otherwise conventional steering wheel 56 and throttle control 58 and instrument panel bearing a tachometer 60 and speedometer 61. In addition, the water craft includes a multipurpose graphical display 63 and/or a discrete input device 65. The graphic display and the touch screen are operably connected to or integrated with controller 54. In the illustrated embodiment, the input device is a discrete touch screen, however, one will appreciate that the graphic display and the input device may be integrated into a single device, for example, a single screen that is suitable for both displaying information and receiving touch screen inputs. Alternatively, a variety of switches, buttons and other input devices may be utilized instead of, or in addition to, a touch screen device.

Display 63 is configured to convey a variety of desired information such as speed of the watercraft, water depth, and/or other useful information concerning the watercraft and operation thereof including, but not limited to, various service alerts, such as low oil pressure, low battery voltage, etc., and/or operational alerts such as shallow water, bilge pump status, etc.

Input device 65 is primarily configured to receive a variety of input commands from the watercraft operator. In accordance with the present invention, and with reference to FIG. 8(*a*), the input display includes a SURF GATE center which serves as input control for operation of surf wake system 32. As shown, the input control may include buttons 67 to activate surf wake system 32 to generate a surfable wake on the left portside or on the right starboard side. For example, if the operator chooses to generate a portside surfable wake, the operator may select left button 67, which in turn would cause controller 54 to extend flap 33*s* to generate a left port side wake in the manner described above. And the operator may similarly press right button 67 to generate a right starboard side surfable wake. In accordance with the present invention, an operator may reconfigure the watercraft to switch from a left surf wake mode to a right surf wake mode by pressing a single button.

One will appreciate that other suitable input means may be utilized to activate the flaps. For example, a graphic or virtual slide assembly may be provided to activate the flaps as to the desired degree left or right, or a plurality of graphic or virtual buttons may be provided to activate the flaps to the desired degree left or right. In addition, one will appreciate that mechanical and/or electromechanical switches and input devices may also be used to activate the flaps as desired.

With reference to FIG. 8(*a*) through FIG. 8(*f*), input device 65 serves as an input device for other watercraft systems such as Malibu Boats' POWER WEDGE system, ballast tank systems (see, e.g., FIG. 8(*c*)), lighting systems (see, e.g., FIG. 8(*d*)), etc.

Also, input device 65. may also provide various alerts regarding the operation of the surf wake system. For example, FIG. 8(*a*) illustrates an operational alert that the once activated, surf wake system will extend above 7 mph and retract under 7 mph. One will appreciate that the surf wake system may be configured to operate only within various speeds deemed suitable for surfing, and may vary from 7 mph. FIG. 8(*b*) illustrates a general error alert, FIG. 8(*c*) through FIG. 8(*f*) illustrate a maximum current warnings for various stages of flap operation to alert the operator of excessive resistance in moving the flaps form one position to another.

In various embodiments, the surf wake system can be configured with various safety features which limit operation and/or alert the driver to various situations. For example, the system may be configured to provide a visual and/or audible alarm to alert the operator when the watercraft is traveling faster than a predetermined speed, for example 15 mph.

Figure 9:
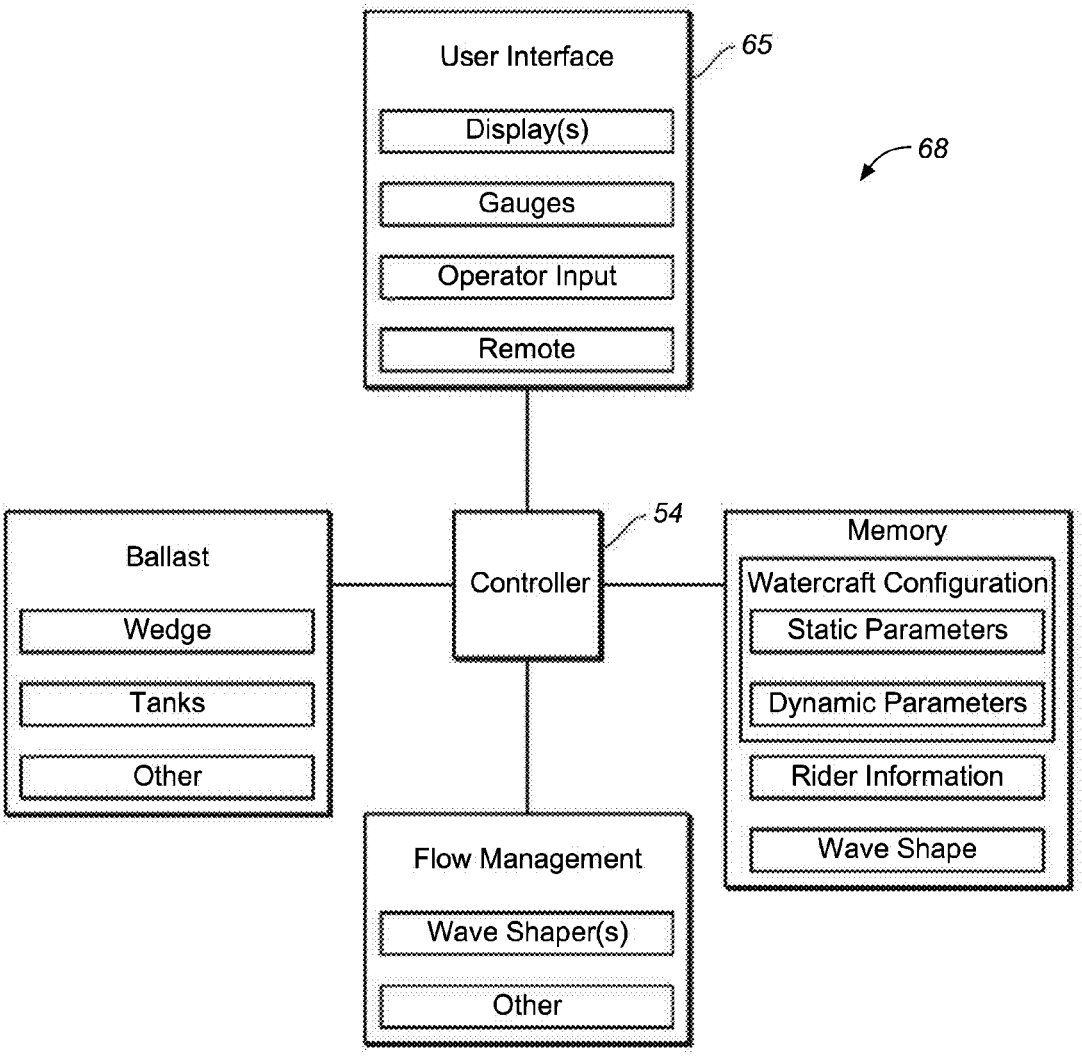
FIG. 9 is a schematic view of an exemplary control system of a surf wake system in accordance with the present invention.

FIG. 9 is a schematic of an exemplary control system 68 in which the user interface, in the illustrated embodiment, input device 65 communicates with controller 54 in order to control flow management by operating associated wave shaper(s), (e.g., flaps 33 and actuators 46). As illustrated and as noted above, input device 65 may also be configured to control other watercraft systems including Malibu Boats' POWER WEDGE system, ballast tank systems.

Control system 32 may also include a memory that is configured to store information regarding watercraft configuration including static parameters such as hull shape, hull length, weight, etc., as well as dynamic parameters passenger weight, ballast, wedge, speed, fuel, depth, wind, etc. The memory may also include "Rider" information regarding the surfer (or boarder or skier), including goofy/regular footed, weight, board length, board type, skill level, etc. Moreover, the memory may be configured to store "presets" that include the information regarding a specific "Rider" including the Rider information as well as the Rider's preferences such as left or right wave, a preferred watercraft speed, a preferred wake height, etc. One will appreciate that the presets could be for the surf wake system as well as other parameters including POWER WEDGE setting, watercraft speed, goofy/regular footed, steep wave face, amount of weight, wave size, etc. One will appreciate that such presets would allow the watercraft operator to quickly reconfigure the surf wake system to accommodate various "Riders", for example very experienced professional wake surfers, beginner wake surfers, and anyone in between.

Control system 32 may also include a remote which may allow a rider to actuate the surf wake system. For example, a remote may allow a rider to further deploy or retract flap 33, to an interim position to vary the size of the wake.

One will appreciate that control system 32 may be integrated into the watercraft, for example, fully integrated with a CAN bus of the watercraft. Alternatively, the control system may be an aftermarket solution which may be installed on a watercraft, either connecting into the CAN bus, or operating completely independently of the CAN bus.

Figure 10:
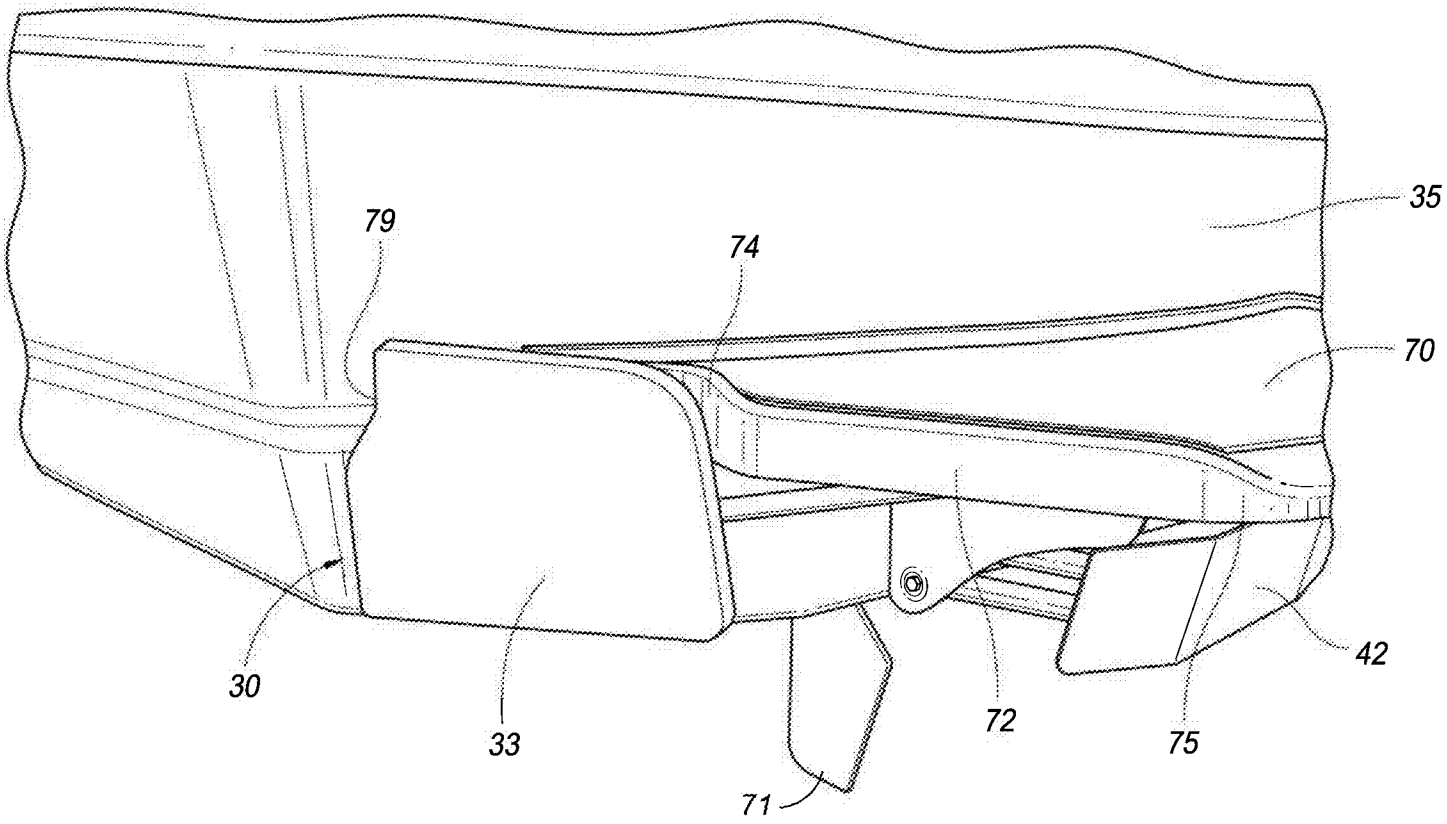
FIG. 10 is a rear perspective view of an exemplary surf wake system including contoured flap assemblies with a complementary swim platform in accordance with various aspects of the present invention.
Figure 11:
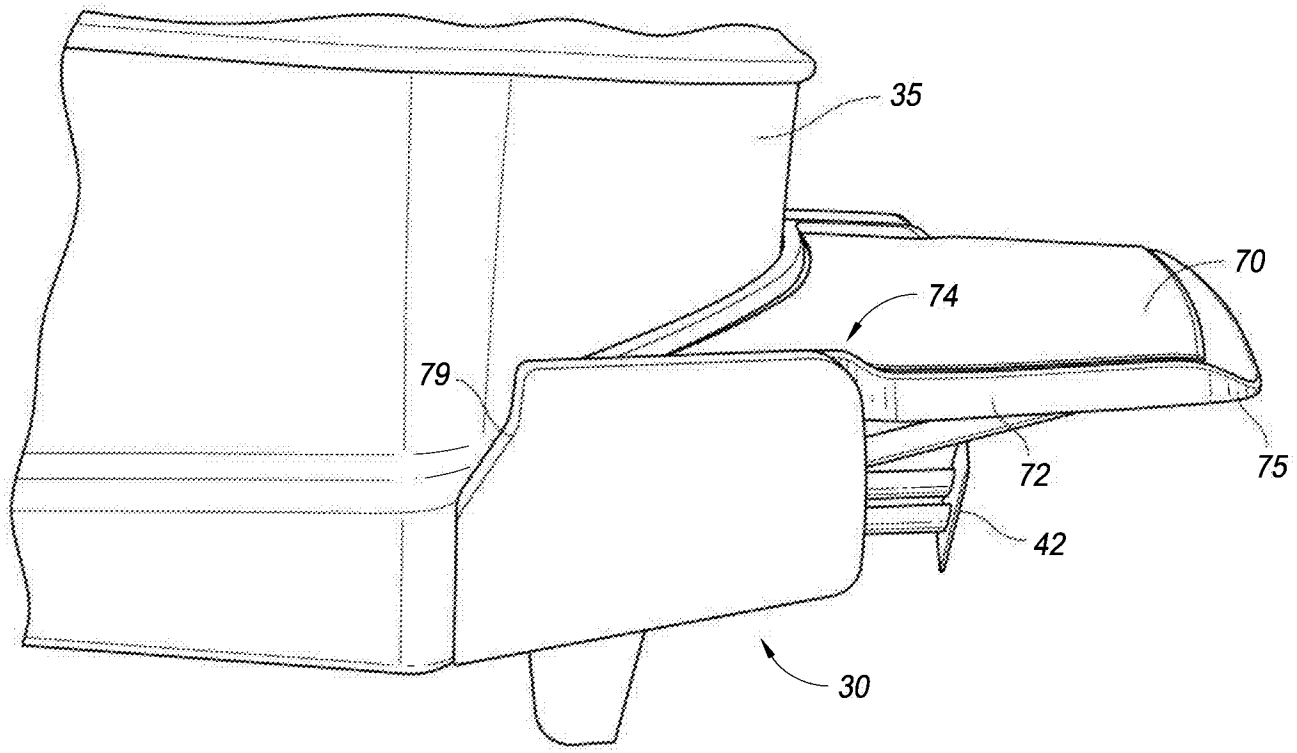
FIG. 11 is a side view of the exemplary surf wake system of FIG. 10.

Turning now to FIG. 10 and FIG. 11, surf wake system 32 may be utilized with a swim platform 70. In the illustrated embodiment, the swim platform includes tapered sides 72 having recessed notches 74 which provide space to receive flaps 33, therein. Such tapered sides and notches allow for flaps 33, to return to neutral positions which have little to no effect on the wake, while allowing for a larger surface area of the swim platform. In the illustrated embodiment, the tapered sides extend inwardly approximately 15-30° from the longitudinal axis, however, one will appreciate that actual angle that the tapered sides angle in may vary, for example, up to approximately 45°. Also, although the depth of the notch is approximately equal to the thickness of the corresponding flap, one will appreciate that the actual dimensions of the notch may vary.

As shown in FIG. 10, the swim platform has rounded corners 75 which are also configured to diminish the effect the swim platform has on the resulting wake. In this regard, the rounded corners lessen the amount of swim platform that contacts water flowing behind the transom, and thus lessens any adverse effect the swim platform may have on the modified wake.

Figure 12A:
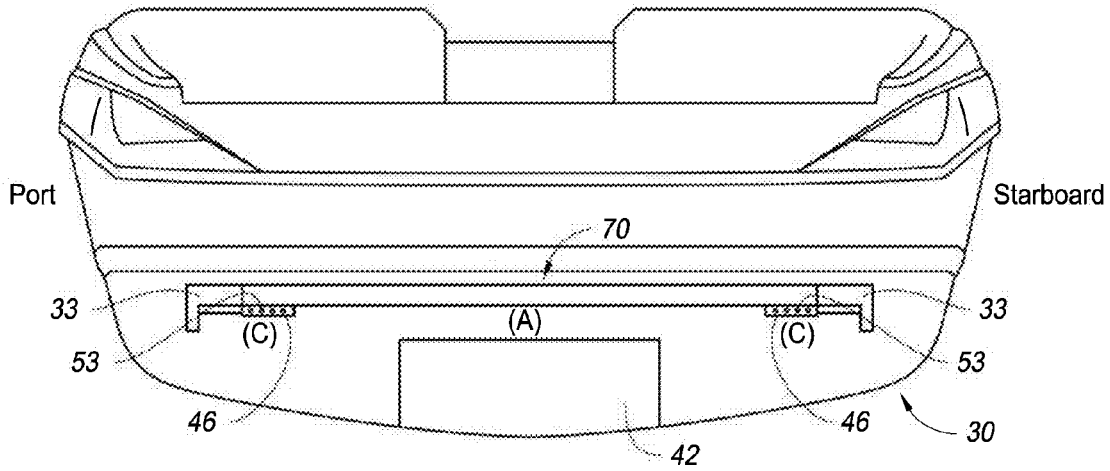
FIG. 12(*a*) and FIG. 12(*b*) are a rear and plan views of an exemplary surf wake system including a flap assembly integrated with a complementary swim platform in accordance with various aspects of the present invention.
Figure 12B:
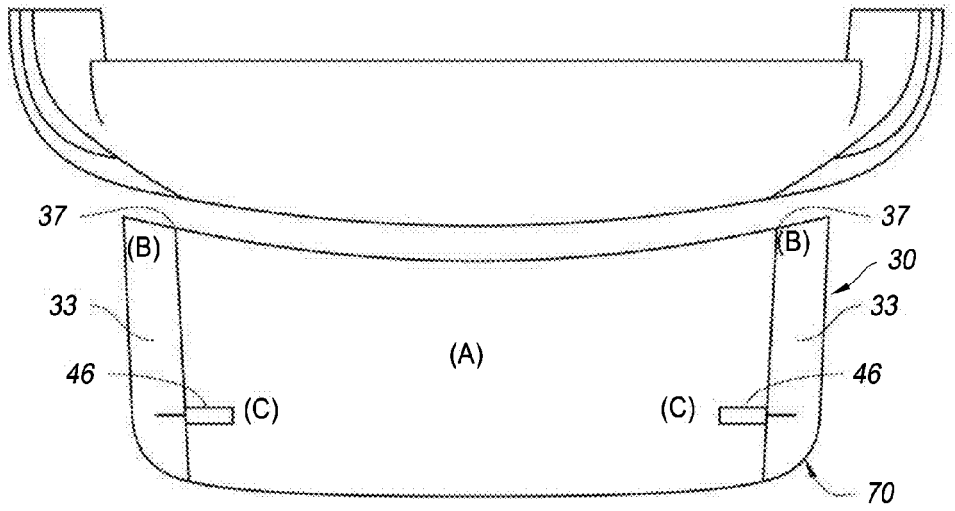

Turning now to FIG. 12(*a*) and FIG. 12(*b*), surf wake system 32 is mostly integrated into a swim platform and can thus be readily installed on an existing watercraft in the form of an aftermarket kit. In various embodiments, swim platform 70 may be mounted to a watercraft in an otherwise conventional fashion, but unlike conventional swim platforms, swim platform 70 includes integrated flaps 33, hinges 37, and actuators 46, in which the integrated assembly may be mounted onto a watercraft in much the same manner as an otherwise conventional swim platform. In the illustrated embodiment, actuators 46 are manually adjustable in the form of a telescopic rod assembly which may be secured in various lengths, for example, by a link pin extending through one of a plurality of holes 53, or by other suitable means. Thus, in various embodiments, the surf wake system of the present invention may be a substantially mechanical system in which the angles of flaps 33 are manually set by the user.

In the illustrated embodiment, the actuators are mounted on the swim platform to selectively deploy the flaps, however, one will appreciate that the actuators may be mounted on the transom.

One will also appreciate that actuators 46 may be automated in a manner similar to that described above, for example, the actuators may be electric, electromechanical, pneumatic and/or hydraulic actuators as described above. In the case that the actuators are automated, the actuators may be integrated with the watercraft's existing control system (e.g., by connecting to the CAN bus of the watercraft), or a dedicated control system may be installed to control the actuators that is completely independent of the watercrafts other systems. For example, the control system may include toggle switches or other suitable devices to selectively move actuators 46 and flaps 33 as desired.

Figure 13A:
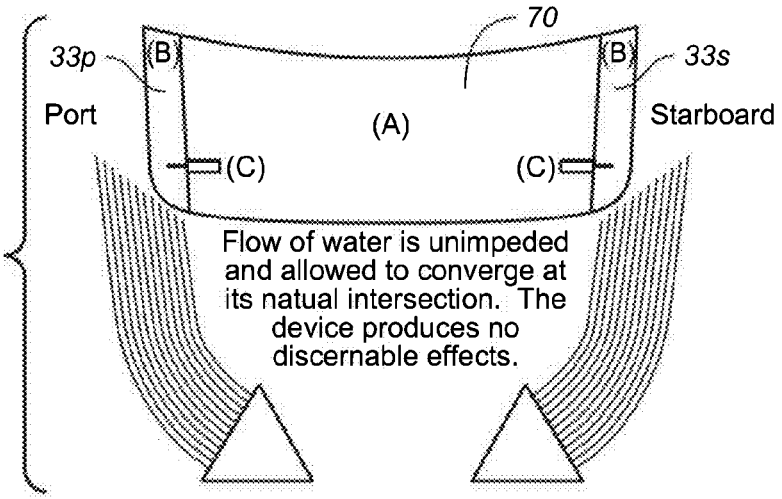
FIG. 13(*a*), FIG. 13(*b*) FIG. 13(*c*) are schematic plan views illustrating the operation of the exemplary surf wake system in accordance with various aspects of the present invention.
Figure 13B:
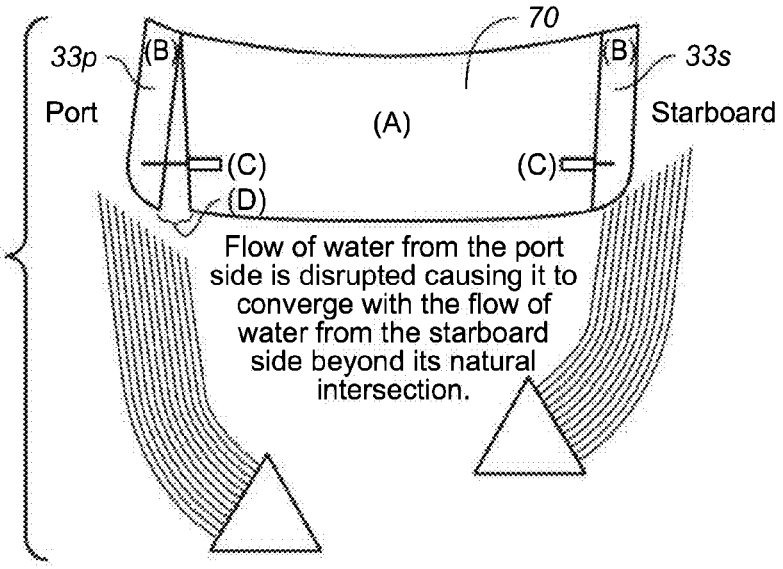
Figure 13C:
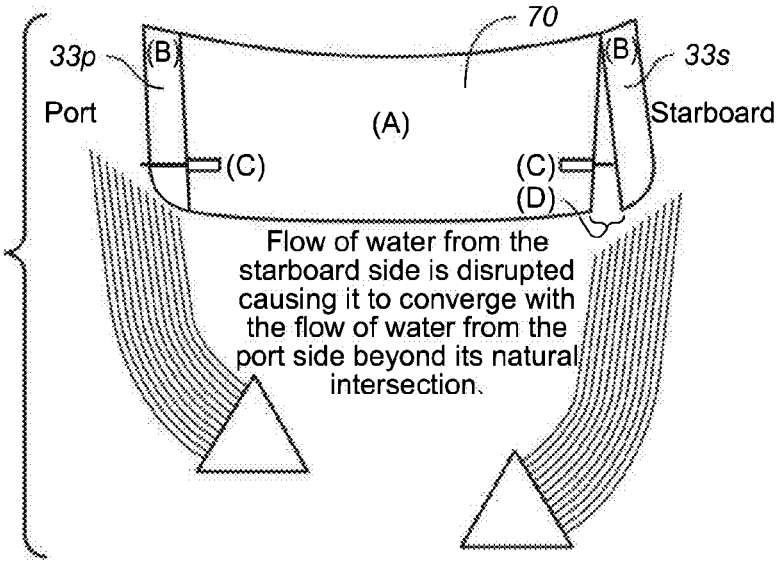

In operation and use, swim platform 70 functions in the same manner as that described above. The neutral position of surf wake system 32 is shown in FIG. 13(*a*) in which flaps 33 are in their neutral, retracted position. In this position, the flow of water past the transom is unimpeded by the flaps and the water is allowed to converge at it is natural intersection relatively close to the transom. When a surfable starboard side wake is desired, the operator may deploy the port side flap 33*p* as shown in FIG. 13(*b*). In this position, the flow of water along the port side past the transom is disrupted such that the flow of water is redirected outwardly and/or rearwardly thereby delaying convergence of the port side flow with starboard side flow to a point further from the transom. Such disruption and redirection facilitates constructive interference of converging waves to form a larger starboard wake with a higher peak and smoother face that is suitable for starboard surfing, such as the waveform shown in FIG. 6(*b*).

Similarly, when a surfable port side wake is desired, the operator may deploy the starboard side flap 33*s* as shown in FIG. 13(*c*). In this position, the flow of water along the starboard side past the transom is disrupted such that the flow of water is redirected outwardly and/or rearwardly thereby delaying convergence of the starboard side flow with the port side flow to a point further from the transom, which facilitates constructive interference of converging waves to form a larger portside wake with a higher peak and smoother face that is suitable for starboard surfing, such as the waveform shown in FIG. 6(*c*).

Figure 14B:
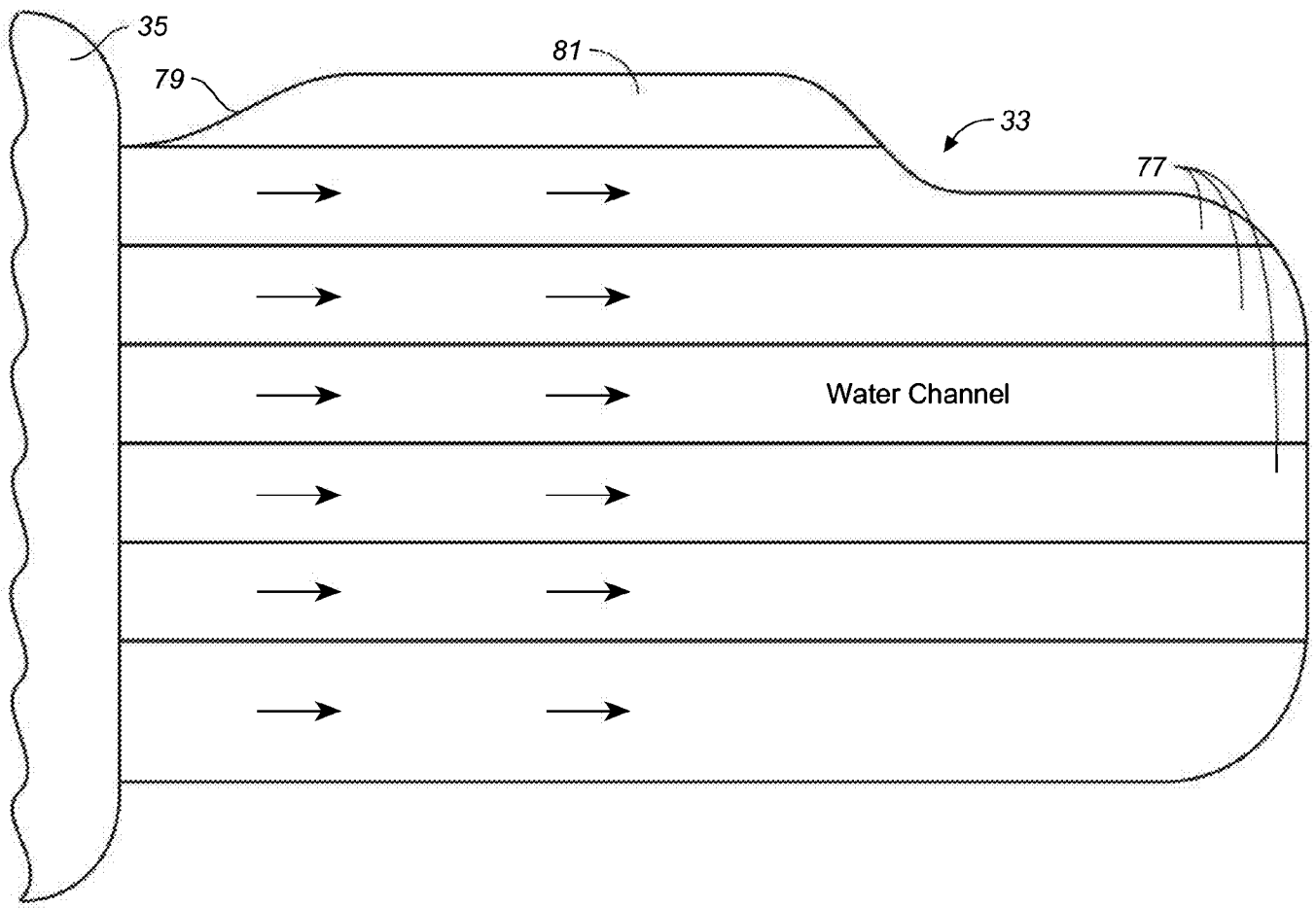
FIG. 14(*a*) and FIG. 14(*b*) are rear and side views of another exemplary flap assembly in accordance with various aspects of the present invention.
Figure 14A:
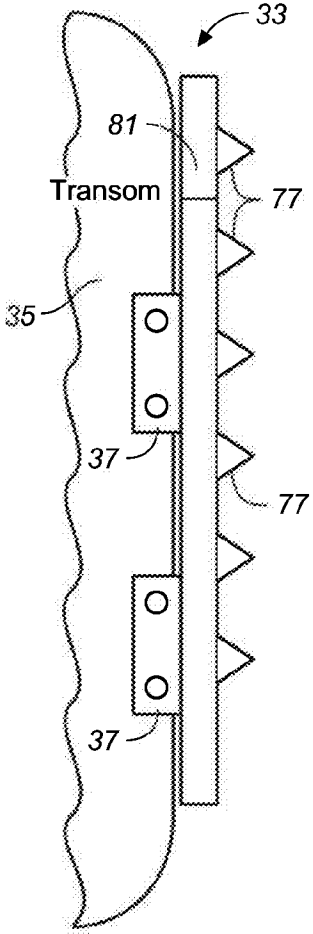

In various embodiments and as noted above, the size and shape of the flaps may vary depending upon varies factors. One such variation is illustrated in FIG. 14(*a*) and FIG. 14(*b*), which shows a channeled flap 33, having a series of parallel horizontally extending channels 77. The channels are on the outboard side of the flap and extend linear to the direction of watercraft travel. The channels may assist in creating laminar flow across the gate, thus producing a cleaner waveform.

In the illustrated embodiment, the flap includes five channels, however, one will appreciate that one, two, three or more channels may be utilized to redirect the flow of water as desired. One will also appreciate that the channel need not be linear or horizontal. For example, the channels may extend at an incline upwardly away from transom 35 to direct the flow of water upwardly as it flows along the surface of flap 33, which may provide a net downward force on the flap and, in turn, the transom to further enhance displacement of the watercraft stern. Also, the channels may be curved in order to gently redirect water upwardly or downwardly. One will also appreciate that other patterns and/or textured surfaces may also be utilized to manage the direction of flow of water along the flap.

Figure 15A:
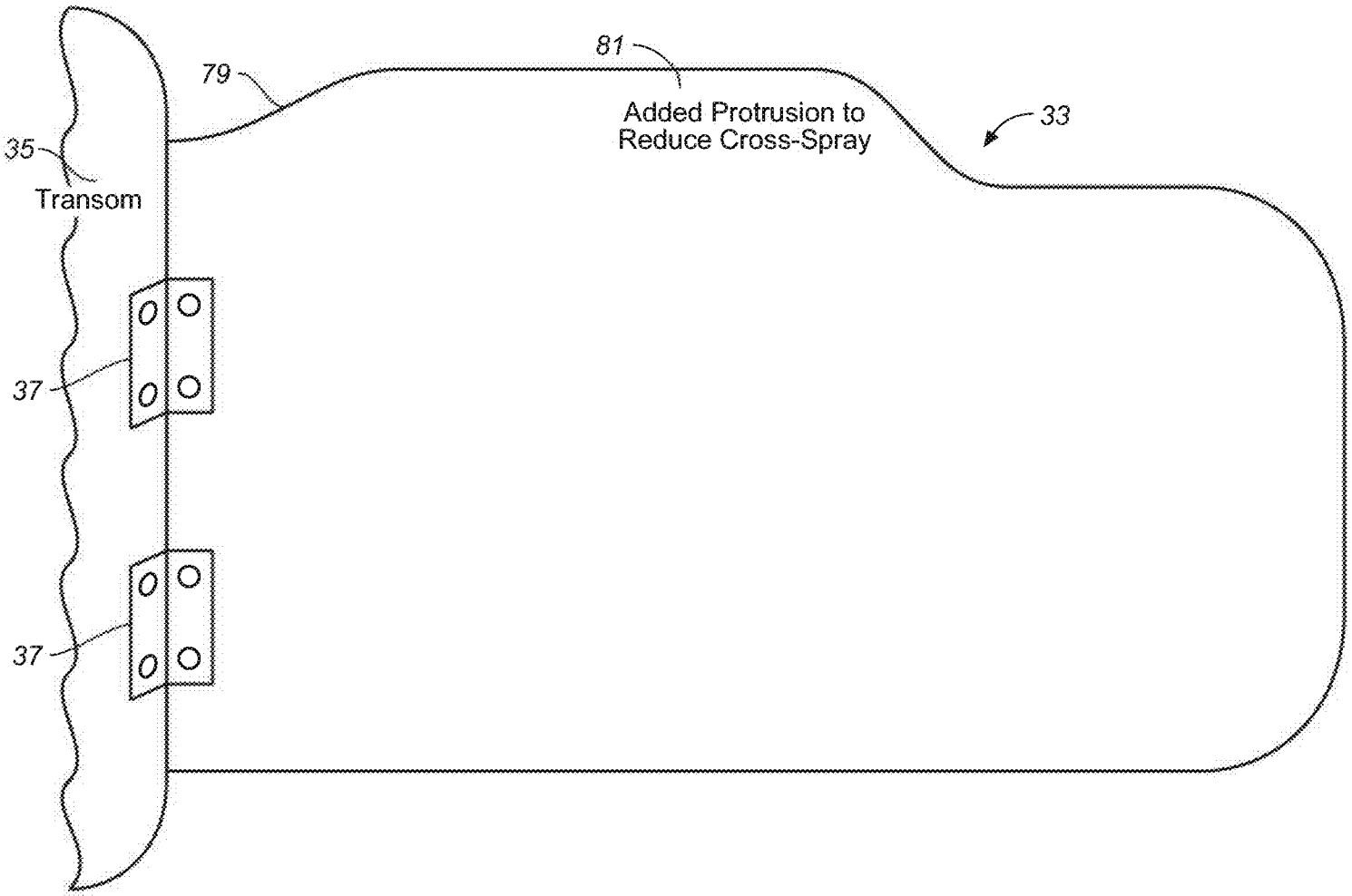
FIG. 15(*a*), FIG. 15(*b*) and FIG. 15(*c*) are side and top views of other exemplary flap assemblies in accordance with various aspects of the present invention.
Figure 15B:
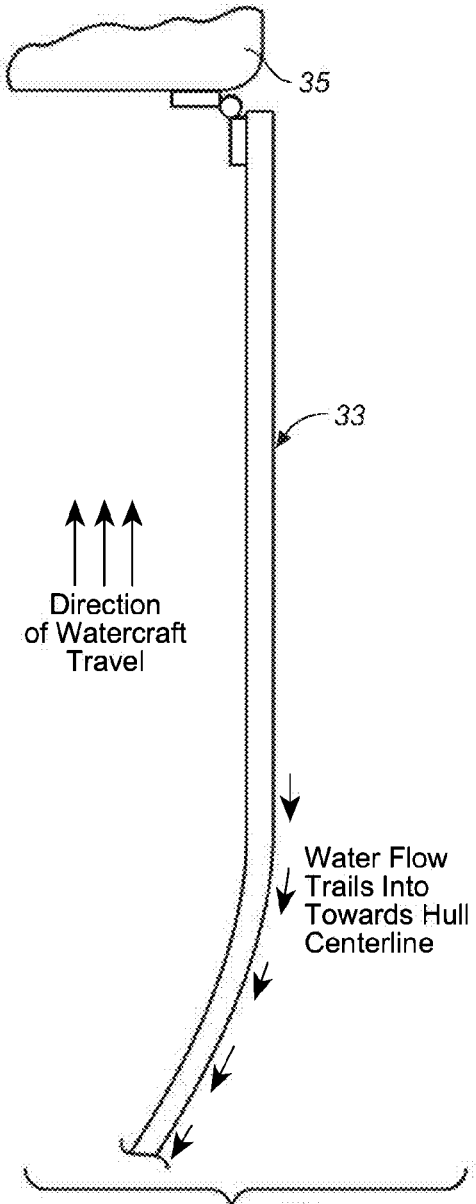
Figure 15C:
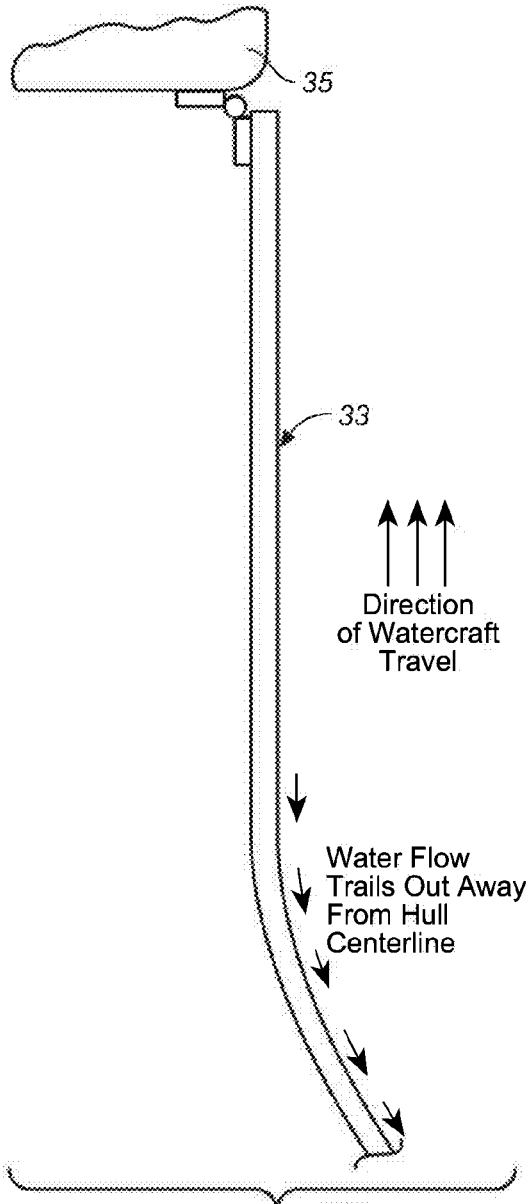

The peripheral shape of flap 33 is similar to that shown in FIG. 10, as well as that shown in FIG. 15(*a*). Flap 33 includes a transom indentation 79 a cross-spray protrusion 81. The transom indentation allows for the flap to be positioned immediately adjacent to the hull such that a minimal gap exists between the transom and the flap, and thus promoting a smooth flow of water along the hull and along the flap. One will appreciate that the actual size and shape of the transom indentation may vary to accommodate for a wide variety of hulls. The cross-spray protrusion is provided to reduce the amount of water at the water line that is inadvertently kicked up in the form of cross-spray, thus reducing the amount of cross-spray formed by deployment of the flaps.

In various embodiments, the flaps may be planar or non-planar. For example, FIG. 15(*b*) shows a convexly-flared flap 33, which allows water flow along the outer surface of the flap that gently trails in towards the hull centerline, while FIG. 15(*c*) shows a concave flap 33, that allows water flow along the outer surface of the flap to be further redirected outward away from the centerline of the hull. One will appreciate that curved flap may effectively extend or otherwise adjust the range of deployment allowing for the use of variously sized actuators. For example, concave flaps may effectively extend the range of deployment such that smaller displacement actuators may be used. Furthermore, convex flaps may reduce face friction, promote laminar flow, or otherwise enhance or modify the wake.

One will appreciate that other flap shapes and configurations may also be utilized in accordance with the present invention, including, but not limited to, oval shaped flaps, other polygonal shapes, perforate surfaces, patterned surfaces, and etc. One will also appreciate that the flaps may be replaceable and interchangeable such that a user may replace flaps of one type with flaps of another type in order to further customize the performance of the surf wake system. Alternatively, supplemental "bolt-on" shapes may be provided which can be attached to an existing flap to further modify its overall shape.

Figure 16A:
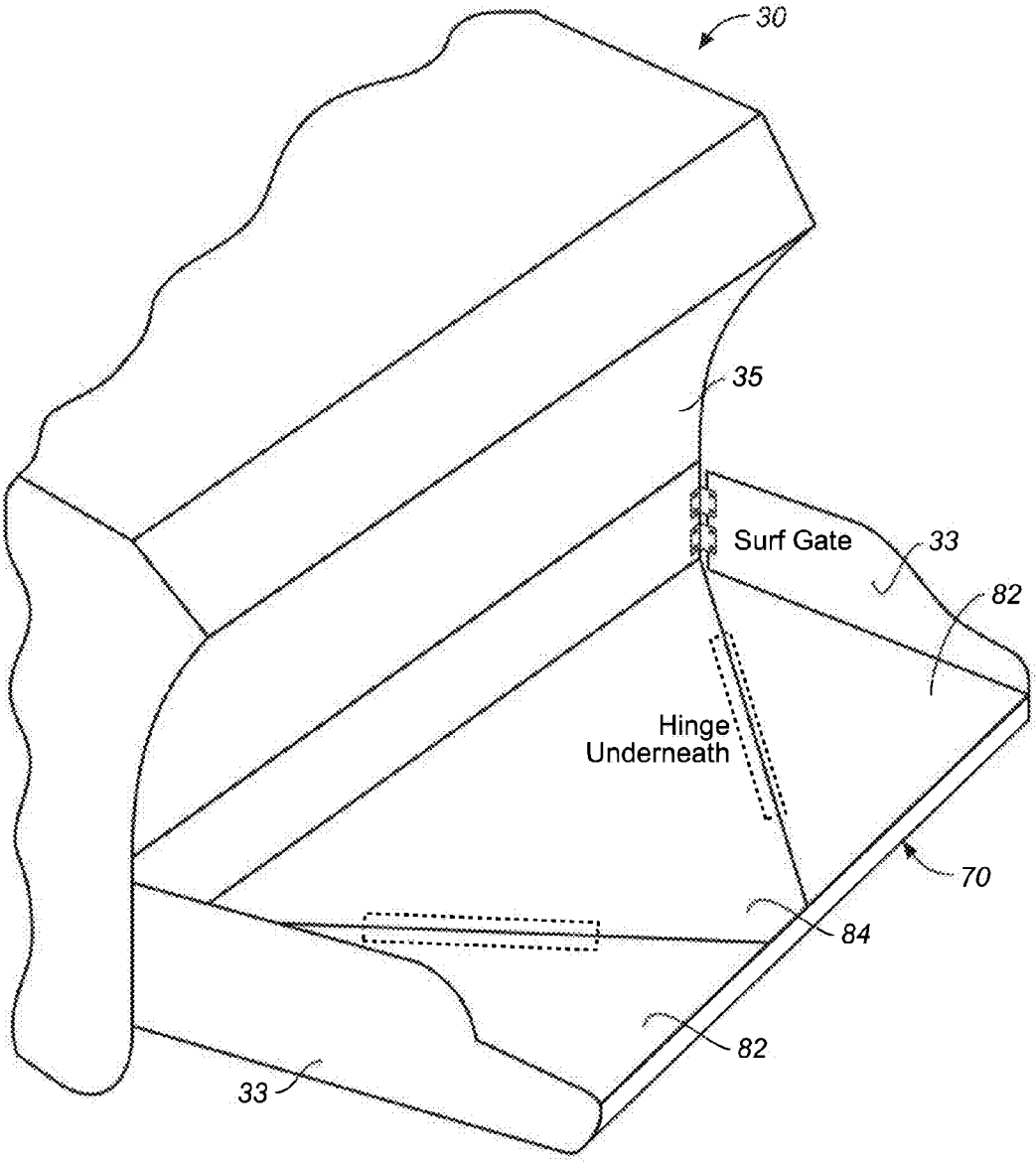
FIG. 16(*a*) and FIG. 16(*b*) are rear perspective and rear elevation views, respectively of another exemplary flap assembly integrated with a complementary swim platform in accordance with various aspects of the present invention.
Figure 16B:
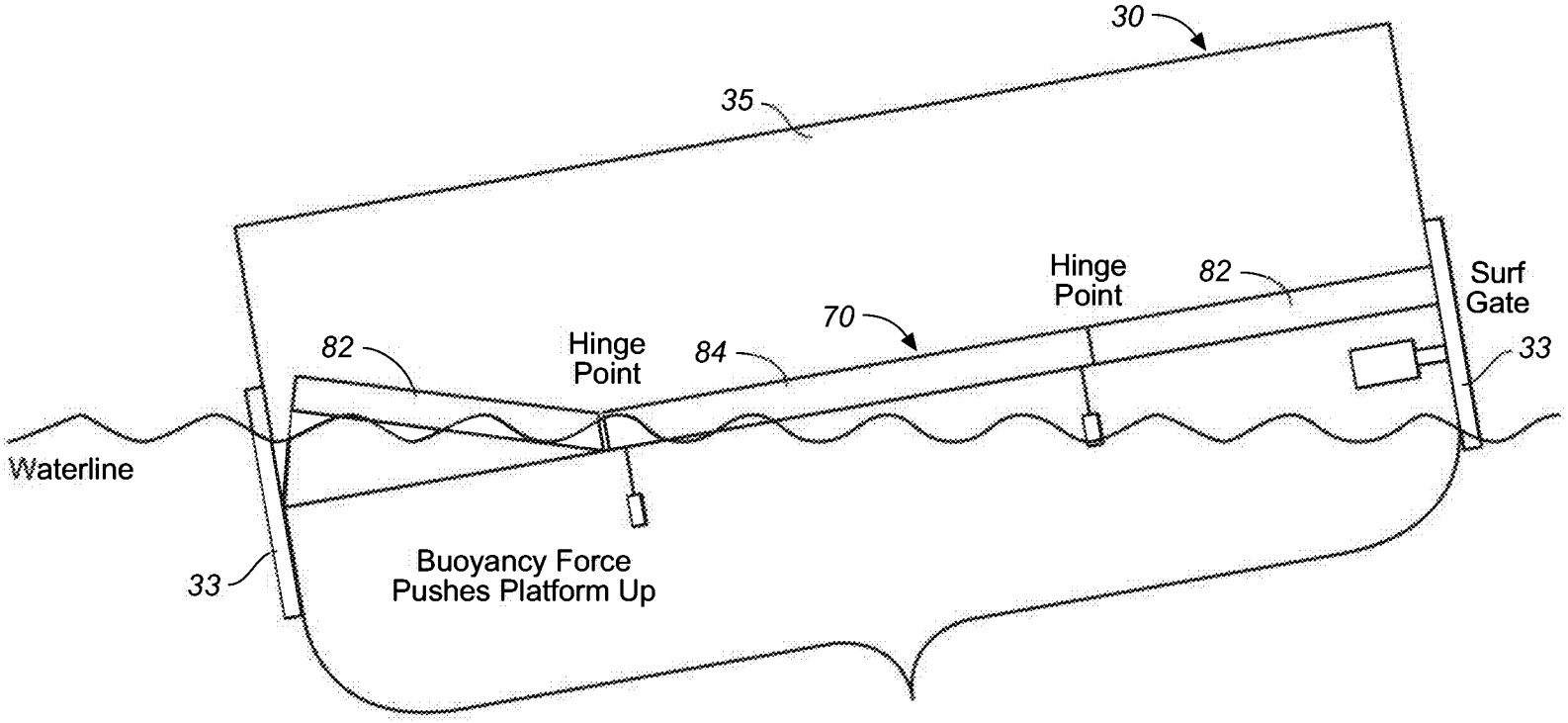

In various embodiments, upper surfaces of the swim platform may be hinged to facilitate the flow of water past the swim platform. Conventional swim platforms generally impede waveform by suppressing water flow on surf side when boat is rolled to the same side. As shown in FIG. 16(*a*) and FIG. 16(*b*), swim platform 70 may be provided with hinged surfaces 82 which are configured to pivot up and away from flow of water as respective side of the swim platform approaches the waterline. The hinged surfaces are designed to allow only upward movement from the resting plan of the swim platform. As shown in FIG. 16(*b*), hinged surface 82 is configured to allow water forces to push the hinged portion up and away from the flow of water creating the resulting surf wave. In the illustrated embodiment, hinged surface 82 is pivotally attached to a fixed main portion 84, whereby the hinged surface may pivot up and not impede waveform. In the illustrated embodiment, the hinged surface is pivotally attached to the fixed main portion by a hinge, however, one will appreciate that other suitable means may be utilized to allow the hinged portion to flex upwardly. One will appreciate that swim platform 70 and hinged surfaces 82 may be used in conjunction or separate from the surf wake system of the present invention.

Figure 17:
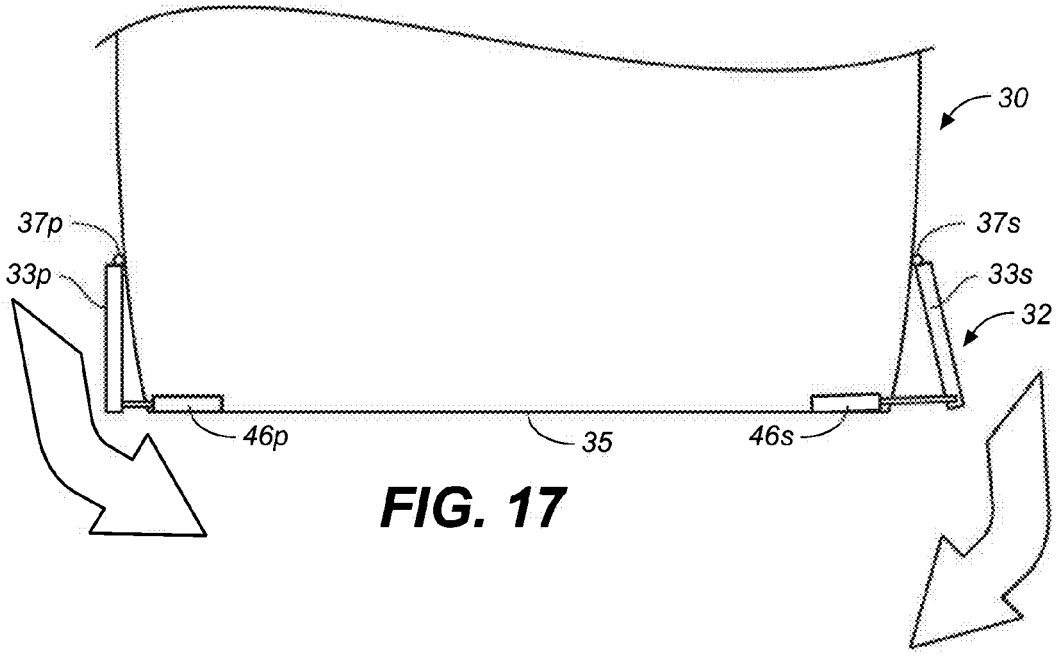
FIG. 17 is a schematic view of an exemplary surf wake system including side-hull flap assemblies in accordance with various aspects of the present invention.

In another exemplary embodiment of the present invention, surf wake system 32 is similar to the systems described above but includes flaps 33 that are mounted on the side of the hull instead of the transom, as shown in FIG. 17. In this embodiment, the actuators are mounted on an appropriate section of the hull to effect deployment from a neutral position, as illustrated by flap 33*p*, to an extended deployed position, as illustrated by flap 33*s*. In a manner similar to the systems described above, deploying a flap will disrupt the flow of water along the side of the hull past the transom such that the flow of water is redirected outwardly and/or rearwardly to facilitate constructive interference of converging waves in a manner that is described above with respect to FIG. 13(*b*) and FIG. 13(*c*).

One will appreciate that the various flap and actuator configurations described above may be utilized with a hull-side configuration.

Figure 18:
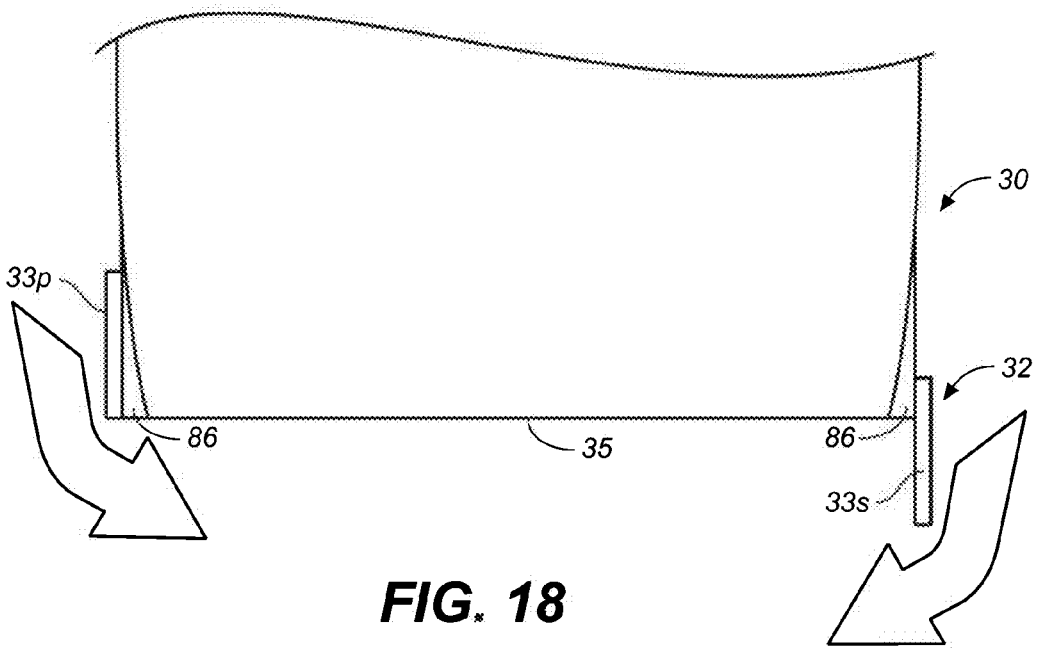
FIG. 18 is a schematic view of an exemplary surf wake system including longitudinally extendable flap assemblies in accordance with various aspects of the present invention.

In still another exemplary embodiment of the present invention, surf wake system 32 is similar to the systems described above but includes flaps 33 that are mounted to extend rearward of transom 35, as shown in FIG. 18. Flaps may be mounted to slide along a track assembly 86 mounted on the side of the hull, or alternatively, may be configured to extend directly outwardly from the hull. In this embodiment, actuators (not shown) are mounted on an appropriate section of the hull or track assembly to effect deployment from a neutral position, as illustrated by flap 33*p*, to an extended deployed position, as illustrated by flap 33*s*. In a manner similar to the systems described above, deploying a flap will disrupt the flow of water along the side of the hull past the transom such that the flow of water is redirected rearwardly to facilitate constructive interference of converging waves in a manner that is described above with respect to FIG. 13(*b*) and FIG. 13(*c*).

One will appreciate that the various flap and actuator configurations described above may also be utilized with such a retractable flap configuration.

For convenience in explanation and accurate definition in the appended claims, the terms "inward" and "outward", "inboard" and "outboard", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An inboard water-sports boat comprising:

a hull having a transom, the hull housing an engine configured to propel the hull through water to produce a wake having eventually diverging port and starboard waves;

a ballast system configured to add and remove water ballast;

a rudder responsive to a steering mechanism to steer the inboard water-sports boat as the hull moves through water;

a surf system configurable by an operator purposefully selecting which of the port wave and the starboard wave to enhance to improve surfing thereon, the surf system comprising:

a port-side deployable element movable between a deployed position and an at least substantially retracted position, wherein at least a portion of the port-side deployable element is configured to redirect water flowing along a port side of the hull when in the deployed position;

a starboard-side deployable element movable between a deployed position and an at least substantially retracted position, wherein at least a portion of the starboard-side deployable element is configured to redirect water flowing along a starboard side of the hull when in the deployed position;

a first positioner configured to hold the port-side deployable element in the deployed position when the port-side deployable element is in the deployed position, wherein the first positioner comprises a manual actuator positioned rearward of the transom such that the manual actuator is manually adjustable by a user manually manipulating the manual actuator of the first positioner at a location rearward of the transom to position the port-side deployable element at the deployed position; and a second positioner configured to hold the starboard-side deployable element in the deployed position when the starboard-side deployable element is in the deployed position, wherein the second positioner comprises a manual actuator positioned rearward of the transom such that the manual actuator is manually adjustable by a user manually manipulating the manual actuator of the second positioner at a location rearward of the transom to position the starboard-side deployable element at the deployed position;

wherein when a rider desires to surf on the port wave, the surf system is configured to enhance the port wave to have a face that is substantially smoother than a face of the starboard wave by positioning the starboard-side deployable element and the port-side deployable element in a first configuration, and wherein when the rider desires to surf on the starboard wave, the surf system is configured to enhance the starboard wave to have a face that is substantially smoother than a face of the port wave by positioning the starboard-side deployable element and the port-side deployable element in a second configuration.

2. The inboard water-sports boat of claim 1, wherein the first positioner comprises a pin configured to selectively engage a plurality of holes to selectively position the port-side deployable element at the at least substantially retracted position and the deployed position, and wherein the second positioner comprises a pin configured to selectively engage a plurality of holes to selectively position the starboard-side deployable element at the at least substantially retracted position and the deployed position.

3. The inboard water-sports boat of claim 1, wherein the first positioner is configured to position the port-side deployable element at one or more interim positions between the at least substantially retracted position and the deployed position, and wherein the second positioner is configured to position the starboard-side deployable element at one or more interim positions between the at least substantially retracted position and the deployed position.

4. The inboard water-sports boat of claim 1, further comprising a remote configured to enable a rider to control the wake.

5. The inboard water-sports boat of claim 1, wherein the inboard water-sports boat is configured to change from enhancing the starboard wave to enhancing the port wave or from enhancing the port wave to enhancing the starboard wave without reconfiguring the water ballast in the ballast system.

6. The inboard water-sports boat of claim 1, wherein the inboard water-sports boat is configured to enhance the port wave or the starboard wave without significant leaning of the inboard water-sports boat to a port or starboard side.

7. The inboard water-sports boat of claim 1, wherein the port-side deployable element pivots between the at least substantially retracted position and the deployed position, and wherein the starboard-side deployable element pivots between the at least substantially retracted position and the deployed position.

8. The inboard water-sports boat of claim 1, wherein the port-side deployable element slides between the at least substantially retracted position and the deployed position, and wherein the starboard-side deployable element slides between the at least substantially retracted position and the deployed position.

9. The inboard water-sports boat of claim 1, wherein each of the port-side deployable element and the starboard-side deployable element comprises at least one of a water diverter, a wake modifier, a flap, and a plate.

10. The inboard water-sports boat of claim 1, wherein the starboard-side deployable element in the deployed position while the port-side deployable element is in the at least substantially retracted position is configured to enhance the port wave to have a face that is substantially smoother than a face of the starboard wave, and wherein the port-side deployable element in the deployed position while the starboard-side deployable element is in the at least substantially retracted position is configured to enhance the starboard wave to have a face that is substantially smoother than a face of the port wave.

11. The inboard water-sports boat of claim 1, wherein the port-side deployable element is an upright deployable element, and wherein the starboard-side deployable element is an upright deployable element.

12. A wake surf system for use with an inboard water-sports boat that is configured to produce a wake having eventually diverging port and starboard waves, the wake surf system configurable by an operator purposefully selecting which of the port wave and the starboard wave to enhance to improve surfing thereon, the wake surf system comprising:

a port-side deployable element configured to be pivotally coupled to an inboard water-sports boat hull proximate a transom, wherein the port-side deployable element is configured to pivot between an at least substantially retracted position and a deployed position, and wherein the port-side deployable element is configured such that at least a portion of the port-side deployable element redirects a flow of water along the port side of the hull proximate the transom when in the deployed position;

a first positioner comprising a manual actuator positioned proximate the transom that is configured to be manually adjustable by a user manually manipulating the manual actuator of the first positioner at a location proximate the transom to move the port-side deployable element between the at least substantially retracted position and the deployed position;

a starboard-side deployable element configured to be pivotally coupled to the inboard water-sports boat hull proximate the transom, wherein the starboard-side deployable element is configured to pivot between an at least substantially retracted position and a deployed position, and wherein the starboard-side deployable element is configured such that at least a portion of the starboard-side deployable element redirects a flow of water along the starboard side of the hull proximate the transom when in the deployed position; and a second positioner comprising a manual actuator positioned proximate the transom that is configured to be manually adjustable by a user manually manipulating the manual actuator of the first positioner at a location proximate the transom to move the starboard-side deployable element between the at least substantially retracted position and the deployed position.

13. An inboard water-sports boat comprising the wake surf system of claim 12 and further comprising:

a hull including a transom, the hull housing an engine configured to propel the hull through water to produce a wake having eventually diverging port and starboard waves;

a ballast system configured to add and remove water ballast; and a rudder responsive to a steering mechanism to steer the hull when the hull is propelled through water;

wherein the port-side deployable element is pivotally coupled to the inboard water-sports boat hull proximate the transom such that at least the portion of the port-side deployable element extends at least laterally into the flow of water when in the deployed position, and wherein the starboard-side deployable element is pivotally coupled to the inboard water-sports boat hull proximate the transom such that at least the portion of the starboard-side deployable element extends at least laterally into the flow of the water when in the deployed position.

14. The inboard water-sports boat of claim 13, wherein the inboard water-sports boat is configured to enhance the starboard wave to have a face that is substantially smoother than a face of the port wave when the inboard water-sports boat travels through water at a speed suitable for surfing with the port-side deployable element in the deployed position and with the starboard-side deployable element in the at least substantially retracted position, and wherein the inboard water-sports boat is configured to enhance the port wave to have a face that is substantially smoother than a face of the starboard wave when the inboard water-sports boat travels through water at the speed suitable for surfing with the starboard-side deployable element in the deployed position and with the port-side deployable element in the at least substantially retracted position.

15. The inboard water-sports boat of claim 14, wherein the inboard water-sports boat is configured to change from enhancing the starboard wave to enhancing the port wave or from enhancing the port wave to enhancing the starboard wave without adjusting the water ballast in the ballast system.

16. The inboard water-sports boat of claim 14, wherein the inboard water-sports boat is configured to enhance the starboard wave without significant leaning of the inboard water-sports boat to the starboard side and to enhance the port wave without significant leaning of the inboard water-sports boat to the port side.

17. The wake surf system of claim 12, wherein the first positioner comprises a pin configured to selectively engage a plurality of holes to selectively position the port-side deployable element at the at least substantially retracted position and the deployed position, and wherein the second positioner comprises a pin configured to selectively engage a plurality of holes to selectively position the starboard-side deployable element at the at least substantially retracted position and the deployed position.

18. The wake surf system of claim 12, wherein the first positioner is configured to position the port-side deployable element at one or more interim positions between the at least substantially retracted position and the deployed position, and wherein the second positioner is configured to position the starboard-side deployable element at one or more interim positions between the at least substantially retracted position and the deployed position.

19. The wake surf system of claim 12, wherein the port-side deployable element is an upright deployable element, and wherein the starboard-side deployable element is an upright deployable element.

20. An inboard water-sports boat comprising:

a hull having a transom, the hull housing an engine configured to propel the hull through water to produce a wake having eventually diverging port and starboard waves;

a ballast system configured to add and remove water ballast;

a rudder responsive to a steering mechanism to steer the inboard water-sports boat as the hull moves through water;

a surf system configurable by an operator purposefully selecting which of the port wave and the starboard wave to enhance to improve surfing thereon, the surf system comprising:

a port-side deployable element movable between a deployed position and an at least substantially retracted position, wherein at least a portion of the port-side deployable element is configured to redirect water flowing along a port side of the hull when in the deployed position;

a starboard-side deployable element movable between a deployed position and an at least substantially retracted position, wherein at least a portion of the starboard-side deployable element is configured to redirect water flowing along a starboard side of the hull when in the deployed position;

a first positioner configured to hold the port-side deployable element in the deployed position when the port-side deployable element is in the deployed position, wherein the first positioner comprises a first pin configured to selectively engage a first hole while being disengaged from a second hole to position the port-side deployable element at the at least substantially retracted position and to selectively engage the second hole while being disengaged from the first hole to position the port-side deployable element at the deployed position; and a second positioner configured to hold the starboard-side deployable element in the deployed position when the starboard-side deployable element is in the deployed position, wherein the second positioner comprises a second pin configured to selectively engage a third hole while being disengaged from a fourth hole to position the starboard-side deployable element at the at least substantially retracted position and to selectively engage the fourth hole while being disengaged from the third hole to position the starboard-side deployable element at the deployed position;

wherein when a rider desires to surf on the port wave, the surf system is configured to enhance the port wave to have a face that is substantially smoother than a face of the starboard wave by positioning the starboard-side deployable element and the port-side deployable element in a first configuration, and wherein when the rider desires to surf on the starboard wave, the surf system is configured to enhance the starboard wave to have a face that is substantially smoother than a face of the port wave by positioning the starboard-side deployable element and the port-side deployable element in a second configuration.

21. The inboard water-sports boat of claim 20, wherein the first positioner is manually adjustable by a user manually manipulating the first positioner at a location rearward of the transom, and wherein the second positioner is manually adjustable by a user manually manipulating the second positioner at a location rearward of the transom.

22. The inboard water-sports boat of claim 20, wherein the first positioner is configured to position the port-side deployable element at one or more interim positions between the at least substantially retracted position and the deployed position, and wherein second positioner is configured to position the starboard-side deployable element at one or more interim positions between the at least substantially retracted position and the deployed position.

23. The inboard water-sports boat of claim 20, wherein the inboard water-sports boat is configured to change from enhancing the starboard wave to enhancing the port wave or from enhancing the port wave to enhancing the starboard without reconfiguring the water ballast in the ballast system.

24. The inboard water-sports boat of claim 20, wherein the inboard water-sports boat is configured to enhance the port wave or the starboard wave without significant leaning of the inboard water-sports boat to a port or starboard side.

25. The inboard water-sports boat of claim 20, wherein the port-side deployable element pivots between the at least substantially retracted position and the deployed position, and wherein the starboard-side deployable element pivots between the at least substantially retracted position and the deployed position.

26. The inboard water-sports boat of claim 20, wherein the port-side deployable element slides between the at least substantially retracted position and the deployed position, and wherein the starboard-side deployable element slides between the at least substantially retracted position and the deployed position.

27. The inboard water-sports boat of claim 20, wherein the starboard-side deployable element in the deployed position while the port-side deployable element is in the at least substantially retracted position is configured to enhance the port wave to have a face that is substantially smoother than a face of the starboard wave, and wherein the port-side deployable element in the deployed position while the starboard-side deployable element is in the at least substantially retracted position is configured to enhance the starboard wave to have a face that is substantially smoother than a face of the port wave.

28. The inboard water-sports boat of claim 20, wherein the port-side deployable element is an upright deployable element, and wherein the starboard-side deployable element is an upright deployable element.

29. A wake surf system for use with an inboard water-sports boat that is configured to produce a wake having eventually diverging port and starboard waves, the wake surf system configurable by an operator purposefully selecting which of the port wave and the starboard wave to enhance to improve surfing thereon, the wake surf system comprising:

a port-side deployable element configured to be pivotally coupled to an inboard water-sports boat hull proximate a transom, wherein the port-side deployable element is configured to pivot between an at least substantially retracted position and a deployed position, and wherein the port-side deployable element is configured such that at least a portion of the port-side deployable element redirects a flow of water along the port side of the hull proximate the transom when in the deployed position;

a first positioner that is manually adjustable to position the port-side deployable element at the at least substantially retracted position and at the deployed position, wherein the first positioner comprises a first pin configured to selectively engage a first hole while being disengaged from a second hole to position the port-side deployable element at the at least substantially retracted position and to selectively engage the second hole while being disengaged from the first hole to position the port-side deployable element at the deployed position;

a starboard-side deployable element configured to be pivotally coupled to the inboard water-sports boat hull proximate the transom, wherein the starboard-side deployable element is configured to pivot between an at least substantially retracted position and a deployed position, and wherein the starboard-side deployable element is configured such that at least a portion of the starboard-side deployable element redirects a flow of water along the starboard side of the hull proximate the transom when in the deployed position; and a second positioner that is manually adjustable to position the starboard-side deployable element at the at least substantially retracted position and at the deployed position, wherein the second positioner comprises a second pin configured to selectively engage a third hole while being disengaged from a fourth hole to position the starboard-side deployable element at the at least substantially retracted position and to selectively engage the fourth hole while being disengaged from the third hole to position the starboard-side deployable element at the deployed position.

30. An inboard water-sports boat comprising the wake surf system of claim 29 and further comprising:

a hull including a transom, the hull housing an engine configured to propel the hull through water to produce a wake having eventually diverging port and starboard waves;

a ballast system configured to add and remove water ballast; and a rudder responsive to a steering mechanism to steer the hull when the hull is propelled through water.

31. The inboard water-sports boat of claim 30, wherein the port-side deployable element is pivotally coupled to the inboard water-sports boat hull proximate the transom such that at least the portion of the port-side deployable element extends at least laterally into the flow of water when in the deployed position, and wherein the starboard-side deployable element is pivotally coupled to the inboard water-sports boat hull proximate the transom such that at least the portion of the starboard-side deployable element extends at least laterally into the flow of the water when in the deployed position.

32. The inboard water-sports boat of claim 30, wherein the inboard water-sports boat is configured to enhance the starboard wave to have a face that is substantially smoother than a face of the port wave when the inboard water-sports boat travels through water at a speed suitable for surfing with the port-side deployable element in the deployed position and with the starboard-side deployable element in the at least substantially retracted position, and wherein the inboard water-sports boat is configured to enhance the port wave to have a face that is substantially smoother than a face of the starboard wave when the inboard water-sports boat travels through water at the speed suitable for surfing with the starboard-side deployable element in the deployed position and with the port-side deployable element in the at least substantially retracted position.

33. The inboard water-sports boat of claim 32, wherein the inboard water-sports boat is configured to change from enhancing the starboard wave to enhancing the port wave or from enhancing the port wave to enhancing the starboard wave without adjusting the water ballast in the ballast system.

34. The inboard water-sports boat of claim 32, wherein the inboard water-sports boat is configured to enhance the starboard wave without significant leaning of the inboard water-sports boat to the starboard side and to enhance the port wave without significant leaning of the inboard water-sports boat to the port side.

35. The wake surf system of claim 29, wherein the first positioner is configured to position the port-side deployable element at one or more interim positions between the at least substantially retracted position and the deployed position, and wherein the second positioner is configured to position the starboard-side deployable element at one or more interim positions between the at least substantially retracted position and the deployed position.

36. The wake surf system of claim 29, wherein the port-side deployable element is an upright deployable element, and wherein the starboard-side deployable element is an upright deployable element.

* * * * *